US005556448A

United States Patent [19]

Cheney et al.

[11] Patent Number: 5,556,448

[45] Date of Patent: Sep. 17, 1996

[54] ELECTROSTATIC PRECIPITATOR THAT OPERATES IN CONDUCTIVE GREASE ATMOSPHERE

[75] Inventors: William A. Cheney; John T. Grady, Jr., both of Cincinnati, Ohio; Victor L. Sellers, Park Hills, Ky.; Kevin Lefler, New Richmond; Robert S. Wilks, Loveland, both of Ohio

[73] Assignee: United Air Specialists, Inc., Cincinnati, Ohio

[21] Appl. No.: 370,865

[22] Filed: Jan. 10, 1995

[51] Int. Cl.[6] ..... B03C 3/68

[52] U.S. Cl. ..... 95/6; 95/81; 96/22; 96/25; 96/26; 96/82; 323/903; 324/76.11; 361/235

[58] Field of Search ..... 95/5–7, 81; 96/22–26, 96/80–82, 66; 55/274, 360; 323/903, 304; 361/235; 324/76.11

[56] References Cited

U.S. PATENT DOCUMENTS

| | | | |
|---|---|---|---|
| 2,935,155 | 5/1960 | Foley | 96/23 |
| 3,073,094 | 1/1963 | Landgraf et al. | 96/66 |
| 3,089,082 | 5/1963 | Little | 96/26 X |
| 3,529,404 | 9/1970 | Quissek | 96/22 |
| 4,318,152 | 3/1982 | Weber | 96/26 X |
| 4,410,934 | 10/1983 | Fathauer et al. | 323/903 X |
| 4,507,131 | 3/1985 | Fathauer et al. | 96/82 X |
| 4,651,264 | 3/1987 | Hu | 323/903 X |
| 4,665,476 | 5/1987 | Masuda | 96/25 |
| 5,330,559 | 7/1994 | Cheney et al. | 96/66 X |

OTHER PUBLICATIONS

MAC Series Installation, operation and cleaning instructions for SMOG–HOG® air cleaning systems, manufactured by United Air Specialists, published Dec., 1992.

GA Series Owner's Equipment Manual for SMOG–HOG®, manufactured exclusively by MCDONALD'S® by United Air Specialists, Inc., published Apr., 1991.

*Primary Examiner*—Richard L. Chiesa
*Attorney, Agent, or Firm*—Frost & Jacobs

[57] ABSTRACT

An improved electrostatic precipitator system is provided for use in high-grease atmospheres in which the grease is electrically conductive. The precipitator includes high-voltage insulators that are both located in areas unlikely to accumulate electrically-conductive grease and that, in themselves, can operate in a high-voltage system without tracking, even when a certain amount of conductive grease has accumulated on the insulators' surfaces. In a multi-cell precipitator system, a high-voltage insulator is provided as part of a cell-to-cell assembly that receives high-voltage electricity on one side of its insulator, and conducts that electricity to its opposite side, and is placed in a specially-shaped cut-out in the bulkhead between the cell chambers, in which the cut-out is shaped so as to minimize the amount of grease that may accumulate upon the cell-to-cell assembly's insulators. The electrostatic precipitator also includes a high-voltage electrical power supply that has special current limiting features and time delay functions that allow it to operate during relatively brief time intervals when a high-humidity atmosphere exists along with the electrically-conductive grease particulate. The electrostatic precipitator also includes electrical door interlocks using safety limit switches to detect whether or not any of the doors have been opened and which shut down the high voltage power of the system in the event of an untimely opening of one of the doors.

10 Claims, 13 Drawing Sheets

D = TOTAL CURRENT DEMAND
I = OUTPUT CURRENT SWITCH
GL = GREEN LED
YL = YELLOW LED
RL = RED LED
YT = YELLOW TIMER
RT = RED TIMER
F = FUSE
T = EXTERNAL LAMP DRIVER
S = 3-POSITION CURRENT RANGE SWITCH *

* S RANGE SWITCH

| POSITION | 1 | 2 | 3 |
|---|---|---|---|
| a ± 5% = | 1.3 mA | 2.2 mA | 3.1 mA |
| b ± 5% = | 1.5 mA | 2.5 mA | 3.5 mA |

FIG. 21

ELECTROSTATIC PRECIPITATOR THAT OPERATES IN CONDUCTIVE GREASE ATMOSPHERE

TECHNICAL FIELD

The present invention relates generally to air filtering equipment particularly directed to an electrostatic precipitator of the type which is capable of operating in a grease atmosphere in which the grease can be electrically conductive. The invention is specifically disclosed as an air cleaning apparatus that receives the exhaust from grease fryers or grills in restaurants, and removes this electrically conductive grease yet can maintain operations for several days between cleanings.

BACKGROUND OF THE INVENTION

Electrostatic precipitators have been in use for many years and are very effective in removing very fine particulate from the atmosphere which otherwise would go unfiltered by merely mechanical means. Removing grease from the cooking exhaust atmosphere requires a specialized electrostatic precipitator, particularly when the grease is both electrically conductive and can arrive at the electrostatic precipitator in rather large droplets. This onerous operating condition can even be made worse by the addition of a high water content in the atmosphere, which commonly occurs when a new batch of frozen french fries is deposited into a deep fryer in a typical fast-food restaurant. Water boils off the frozen french fries almost immediately, thereby creating a very high humidity atmosphere in addition to the grease particulate.

Conventional electrostatic precipitators that remove particulate from cooking exhaust gases have been constructed of one or more cell assemblies-each containing a set of collecting plates and an ionizer-that are fed high-voltage electrical power from an electrical feed plenum located behind the cell assembly compartment(s). Each cell assembly essentially had an independent power feed. In addition, the high-voltage feed plenum required that the overall cabinet have a much greater depth than that required for the cell assemblies alone. Other conventional such electrostatic precipitators have been constructed by feeding the high-voltage electrical power from the side of the cell assemblies, however, the collecting cells of each cell assembly compartment were accessible only from the sides of the electrostatic precipitator so that any interior cells (rather than the outermost cells) had to be slid along a longitudinal rack for insertion or removal.

One primary concern with the use of electrostatic precipitators in removing electrically conductive grease particulate is the fact that the grease tends to accumulate in undesirable places, such as on electrical insulators, and this grease must be periodically removed. In view of this fact, such electrostatic precipitators must be placed into a "cleaning" mode after a certain well defined number of operating hours, depending upon the design of the electrostatic precipitator. A major limitation of conventional electrostatic precipitators is that this cleaning mode must occur quite frequently to keep the equipment in good operating order, and to prevent a dangerous situation in which the grease can catch on fire if a sufficient concentration occurs at a location having a high voltage gradient.

Grease fires are a common occurrence for this type of electrostatic precipitator equipment, as evidenced by the fact that such units are normally required to contain some type of fire or smoke detector system, and a fire extinguishing system. The problem of this electrically conductive grease collecting on the collecting elements and other components of the electrostatic precipitator is so insidious that some conventional designs actually construct some type of pan or trough to hold the liquid grease as it accumulates on the collecting components and drains downward toward the bottom of the precipitator, so that the grease can accumulate in a location that may not have electricity passing over it. In some designs, such a trough or pan can actually have holes to automatically drain the grease from the electrostatic precipitator. The major problem with a system having drain holes is that, since the grease atmosphere is typically arriving from directly below the electrostatic precipitator (i.e., the electrostatic precipitator is mounted directly above the deep fryers, as in a conventional hood arrangement), any type of hole in the bottom surface of the electrostatic precipitator will tend to allow a certain amount of "blow-by" of particulate that will not be channeled into the main collecting elements of the electrostatic precipitator. Any such blow-by will reduce the efficiency of the electrostatic precipitator, mainly due to the fact that a certain percentage of the particulate are never filtered at all. Some conventional electrostatic precipitators introduce clean air at their inlet to dilute the contaminated air and help clean the insulators; this arrangement obviously reduces the efficiency and the cleaning capacity of such convention electrostatic precipitators.

In an electrostatic precipitator designed to collect electrically-conductive grease, it is beneficial to provide as much electrical insulation as possible at all of the high-voltage elements within the system, and it is beneficial to direct any potentially accumulating grease away from such insulative elements. It is also beneficial to prevent as much as possible any blow-by of particulate around the main collecting elements of the electrostatic precipitator, and to construct the system in which the time intervals between mandatory cleanings is as long as possible. It is additionally beneficial to provide as much safety as possible during normal operation and cleaning operations of the electrostatic precipitator.

SUMMARY OF THE INVENTION

Accordingly, it is a primary object of the present invention to provide an electrostatic precipitator system that provides insulators with high voltage ratings for all of the high-voltage components of the system, and to place these insulators in locations that are not likely to accumulate electrically-conductive grease during operation of the system.

It is another object of the present invention to provide a very safe-to-operate electrostatic precipitator system which utilizes door interlocks and door limit switches to prevent unauthorized access to the high-voltage components, and to detect when such access has occurred.

It is a further object of the present invention to provide an electrostatic precipitator system that prevents the high voltage cell assemblies from being placed into the collecting chambers or compartments incorrectly.

It is yet another object of the present invention to provide an electrostatic precipitator system having a high-voltage power supply that can greatly extend the time the system can operate successfully in high-humidity atmospheres, along with the electrically-conductive grease particulate, while also limiting the risk of a fire.

It is yet a further object of the present invention to provide an electrostatic precipitator system having a single high-voltage power feed into the side of one of the cell assemblies, and then continuing to feed the electrical power to the sides of other cell assemblies, all being sourced by the single power feed, while allowing insertion/removal access to each of the cell assemblies from the front of the electrostatic precipitator.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved electrostatic precipitator system is provided having high-voltage insulators that are both located in areas unlikely to accumulate electrically-conductive grease and that, in themselves, can operate in a high-voltage system without tracking, even when a certain amount of conductive material has accumulated on the insulators' surfaces. A high-voltage infeed insulating device is provided to accept two different high voltage cables or wires from a high-voltage power supply, one to be attached to the ionizer wires, and a second to be attached to the high-voltage plates of the accumulating cell assemblies. This high-voltage infeed assembly provides virtually the maximum possible distance between grounded and high-voltage components within the overall size constraints of the entire electrostatic precipitator system. In a multi-cell precipitator system, another high-voltage insulator is provided as a cell-to-cell assembly, which receives high-voltage electricity on one side of its insulator, and conducts that electricity to its opposite side so that it can transfer this high-voltage electricity from either the high-voltage plates or the ionizer wires of one cell assembly to an adjacent cell assembly. This insulative cell-to-cell assembly is preferably placed within a cut-out in the bulkhead between the cell chambers or compartments, and this cut-out is preferably shaped so as to minimize the amount of grease that may accumulate upon the cell-to-cell assembly's insulators.

The electrostatic precipitator system also includes a high-voltage electrical power supply that has special current limiting features and time delay functions that allow it to operate at higher current levels during relatively brief time intervals when a high-humidity atmosphere exists along with the electrically-conductive grease particulate. The total output current of the power supply is compared to a predetermined threshold, and if the output current continuously exceeds that threshold for a given time interval, then a warning lamp is illuminated. If the output current increases further, and continuously exceeds a second greater threshold for another given time interval, then a second warning lamp is illuminated and the output current magnitude is clamped to a maximum value equal to the (second) greater threshold, which will cause the operation of the electrostatic precipitator to terminate.

An electrostatic precipitator system is also provided that is very safe to operate, by use of a grounding spring on each of the doors that open to allow access to the cell assemblies for cleaning. This grounding spring, in conjunction with a bracket on the cell assembly, also acts as a "key" to prevent the cells being placed into their cell chambers upside-down or backwards after their cleaning cycle has been finished. In addition, these doors are not only mechanically locked, but have additional interlocking safety limit switches to detect whether or not any of the doors have been opened and which shut down the high voltage power of the system in the event of an untimely opening of one of the doors. The door safety limit switches are part of an electrical door interlock which is constructed to require only a minimum amount of depth so as to not interfere with other components of the system, yet only requires one fastener that holds each electrical limit switch in place as well as one-half of the mechanical assembly that operates as a dual door opening detector, with all other mechanical moving parts being design to mate together without the use of fasteners.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

FIG. 21 is a second page of the flow chart of FIG. 20, providing information in a chart format.

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
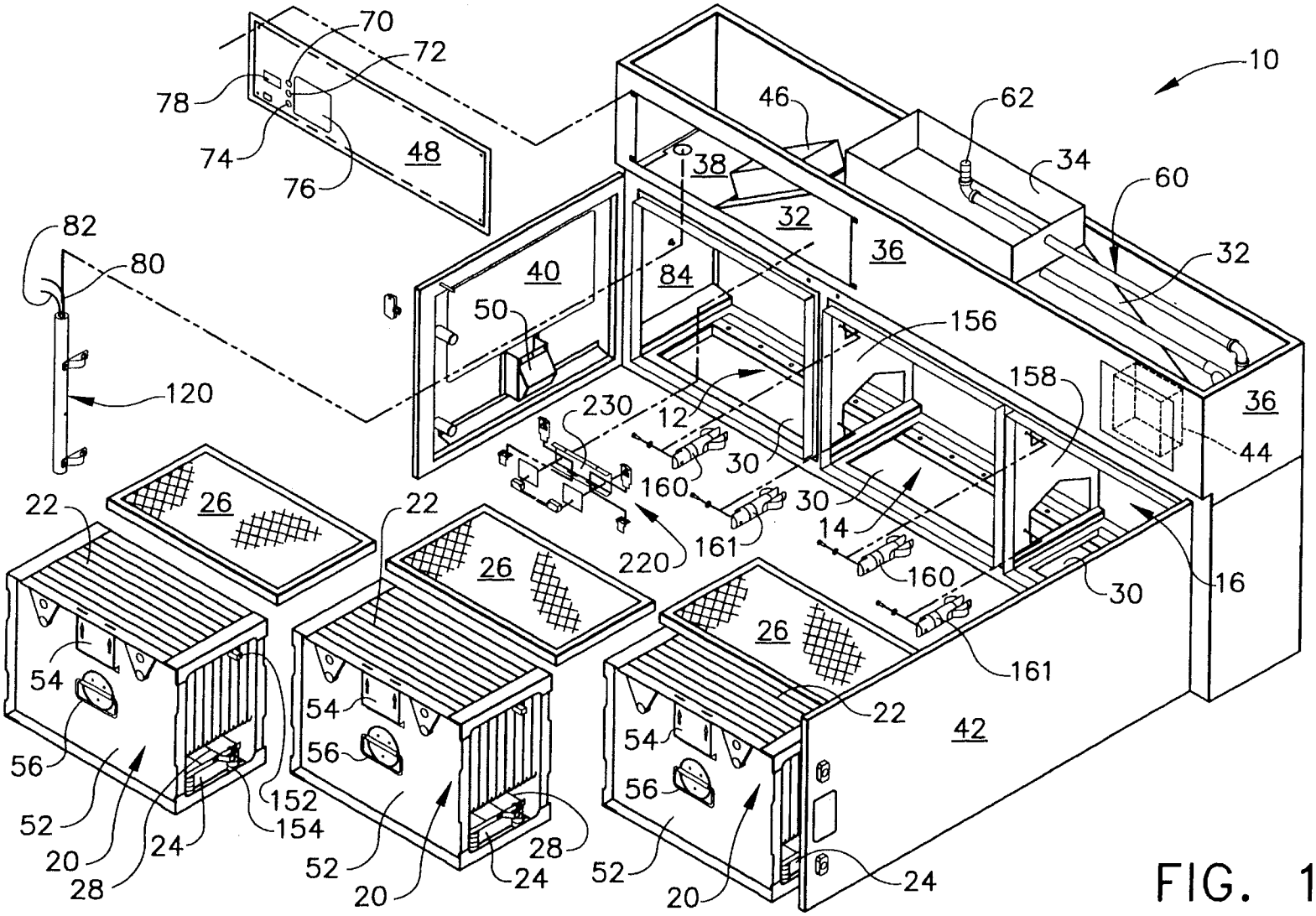
FIG. 1 is an exploded perspective view of an electrostatic precipitator constructed according to the principles of the present invention.

Referring now to the drawings, FIG. 1 shows an electrostatic precipitator, generally designated by the index numeral 10, constructed in accordance with the principles of the present invention, and as illustrated, containing three separate chambers or compartments designated by the index numerals 12, 14 and 16. FIG. 1 is also an exploded view for ease of showing some of the inner details of electrostatic precipitator 10, while also showing details of certain of the various components included in the apparatus. Each of chambers 12, 14, and 16 would typically contain, during operation, a cell assembly 20, which contains a grid of interleaving, parallel grounded conductive plates and high-voltage conductive plates at the location designated by the index numeral 22, and further contains a high-voltage ionizer assembly designated by the index numeral 24.

Electrostatic precipitator 10 is designed to remove particulate from the atmosphere in which the airflow is directed through the open bottom, designated by the index numeral 30, for each of chambers 12, 14, and 16, in which this open bottom acts as the inlet for electrostatic precipitator 10. The airflow then travels through the cell assemblies 20, then further through an aluminum mesh filter 26 that is attached above on the cleaned air side of each of these cell assemblies 20, yet further through a hood-like structure 32 that narrows the cross-sectional area of the air passageway, and finally to an outlet designated by the index numeral 34. In this manner, electrostatic precipitator 10 can be placed directly above a source of dense particulate, such as a french-frying apparatus, and can be used to collect the air in the spaces above that french-frying apparatus while cleaning this air before exhausting it through the roof of the building.

As can be seen in FIG. 1, after the cell assemblies 20 are placed within their respective chambers or compartments 12, 14, and 16, the left-hand and right-hand doors, designated by the index numerals 40 and 42, respectively, can be closed to seal the air spaces within those chambers. Once doors 40 and 42 are closed, the bottom portion of electrostatic precipitator 10 becomes a rectangular box, and the upper portion which contains the hood 32 is preferably surrounded by a protective housing typically called a fascia, designated by the index numeral 36. Several important components are contained within fascia 36, including an electrical enclosure 44 (which acts as a junction box for line power to be brought into electrostatic precipitator 10), a high-voltage power supply 46, and a control panel 48 which is preferably mounted on the front surface of fascia 36 for ease in viewing its various indicators.

It is important that cell assemblies 20 be installed in the correct orientation, so a keyed structure is preferably included as pan of the door and cell assembly mechanisms. One method of accomplishing this key is to use a ground spring 50, installed inside each of the doors 40 and 42 (i.e., door 42 would have two such ground springs, one per cell assembly 20), which are each designed to contact against the planar surface of each of the cell assemblies 20 at a location designated by the index numeral 52. If cell assembly 20 is installed upside-down, then a special plate designated by the index numeral 54 will interfere with the closing of the door because ground spring 50 will attempt to push plate 54 in further than the ground spring can deflect. Plate 54 thereby acts as a "keying plate" and can be additionally utilized to have a multi-language sign on its outer surface that indicates, "This side up". Ground spring 50 also is preferably used to provide a solid electrical ground connection between the grounded doors and framework of electrostatic precipitator 10 and each of the cell assemblies 20 along their planar surface at the contact surface points 52.

Each of the cell assemblies 20 is preferably equipped with a hingeable handle, designated by the index numeral 56. Hinged handle 56 is preferably designed to make it as easy as possible for a person to remove a cell assembly 20 for cleaning purposes by unfolding the handles so that the person can put his fingers through the open loop of handle 56, and then pull on that handle to slide each cell assembly 20 out of its respective chamber 12, 14, or 16, along a specially-designed track that effectively provides a sliding way for the bottom-side edges of each cell assembly 20. When the cell assembly 20 is to be reinstalled into its respective chamber, the person merely lifts the cell assembly 20 to the opening of its respective chamber 12, 14, or 16, and then starts to slide that cell assembly 20 into its chamber while holding handle 56 in its open, extended position. Once cell assembly 20 is properly pushed all the way into its respective chamber, hinged handle 56 can be folded over to the side to provide sufficient clearance so that the doors 40 and 42 can be properly closed to seal the cabinet of electrostatic precipitator 10.

A separate fire extinguishing system, designated by the index numeral 60, along with a fire or smoke detector (not shown), is preferably installed in the upper portions of the area surrounded by fascia 36, in which the fire extinguishing system 60 has a wet chemical nozzle 62 located at the outlet 34 of electrostatic precipitator 10, in case some of the grease produces a flash fire during the operation of electrostatic precipitator 10. Since many of the greases used in restaurants, particularly for a french-frying procedure, are electrically conductive, great care must be taken to minimize the chances of a high-voltage discharge occurring in areas where such conductive grease has accumulated. One of the most important aspects of the present invention is to prevent the accumulation of such conductive grease upon components that incur a voltage gradient during normal operation, as discussed in greater detail hereinbelow. Unfortunately, the combination of high voltage power and electrically conductive accumulated grease increases the chance of a flash fire to the point where a fire extinguishing system is a virtual necessity for such equipment, even in a system such as electrostatic precipitator 10 in which great care is taken to prevent such fires.

In a typical installation, alternating current line power is brought into electrical enclosure 44, which preferably has a terminal block (not shown) for ease in terminating the electrical conductors carrying the line power. On the load side of these terminal blocks, the line power is taken along further electrical conductors (not shown) to high-voltage power supply 46. High-voltage power supply 46 preferably creates two different output voltages, a 6 kV output voltage that is ultimately carried to the high-voltage parallel plates of each of cell assemblies 20, and a much higher voltage 11 kV output that is carried to the high-voltage wires 28 of each of the ionizer assemblies 24. High-voltage power supply 46 is preferably designed to be current-limiting, so as to prevent any possibility of an electrical shock of sufficient intensity to harm a human being, and preferably maintains a constant voltage output up to its normal operating current limit. In addition, high-voltage power supply 46 is preferably designed to operate in high-humidity conditions within electrostatic precipitator 10 for relatively short time intervals. This is accomplished by the use of current sensing elements, timers, comparators, and current clamping devices, and is described in detail hereinbelow.

Control panel 48 in the illustrated embodiment contains three indicating lamps, preferably a green LED 70, yellow LED 72, and red LED 74, which are preferably located next to a sign or label 76 that indicates the meaning of each of these LEDs being illuminated. In the preferred embodiment of electrostatic precipitator 10, green LED 70 indicates that the filtering/collecting process of the precipitator is operating under normal conditions, the yellow LED 72 indicates that the collectors (i.e. cell assemblies' 20) need cleaning, and the red LED 74 indicates that the collectors are now dirty. In addition to the above, it is preferred that an hour meter 78 be provided to record the length of time that electrostatic precipitator 10 has been operated while the red LED 74 is illuminated.

Figure 4:
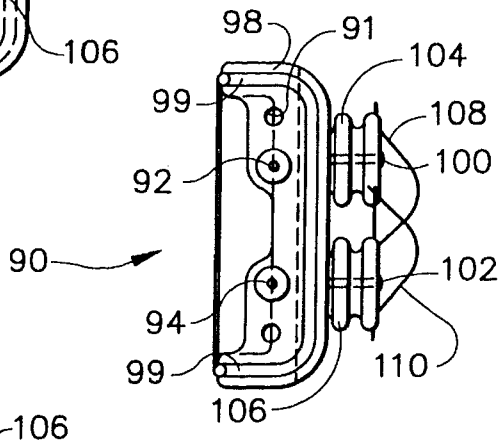
FIG. 4 is an end view of the first embodiment high voltage infeed assembly depicted in FIG. 2.
Figure 2:
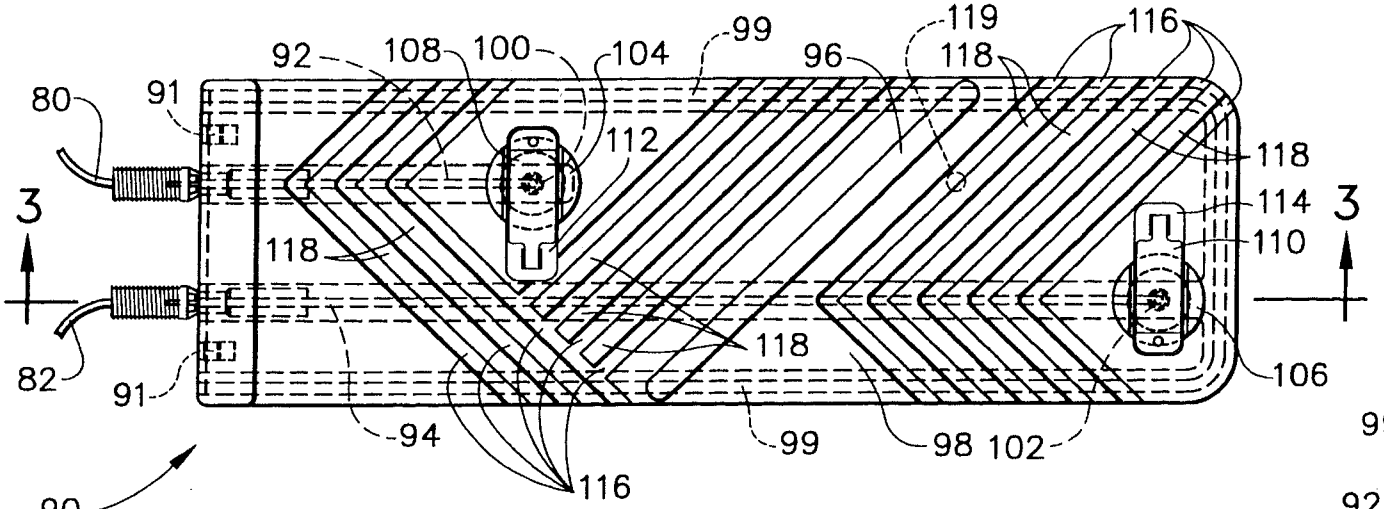
FIG. 2 is a front view of a first embodiment of a high-voltage infeed assembly, constructed in accordance with the principles of the present invention.

The outputs of high-voltage power supply 46 are preferably run through a pair of insulated wires 80 and 82 from power supply 46 and into a high-voltage infeed assembly. A first embodiment of such a high-voltage infeed assembly is designated by the index numeral 90, and can be best viewed in FIGS. 2, 3, and 4. As seen in FIG. 2, high-voltage infeed assembly 90 contains two electrical conductors, designated by the index numerals 92 and 94. When installed along the inner-left wall surface, designated by the index numeral 84, of electrostatic precipitator 10, the left-hand side (in FIG. 2) becomes the top portion of high-voltage infeed assembly 90, and high-voltage conductor 92 carries current to the high voltage plates of the subassembly of plates 22, while high-voltage conductor 94 carries the current to ionizer wires 28.

The main body portion 98 of high-voltage infeed assembly 90 preferably comprises some type of insulative plastic material that can be easily molded, and preferably has several chevron-shaped trenches or grooves, designated by the index numeral 116, having a land 118 between each pair of grooves 116, as well as a rib 96, all configured to aid in directing any grease that may accumulate along the inner left-wall of electrostatic precipitator 10 (and that may accumulate on the surface of high-voltage infeed assembly 90) away from the high-voltage conductors that transfer the current from high-voltage conductors 92 and 94 to their loads, and from the high-voltage conductors 108 and 110. Rib 96 also acts as a baffle to redirect the air that moves along the upper surface of body 98 away from one of the high-voltage output terminals (see below).

The plastic body 98 is preferably molded so that there are interior channels that essentially surround conductors 92 and 94 with its electrically insulative plastic material along the conductors' length until the conductors terminate at their respective output connector terminals, designated by the index numerals 100 and 102. Body 98 is preferably sealed to the cabinet wall 84 and horizontal wall 38 via a continuous length of cord gasket pressed into a channel 99 in the back of body 98. The sealing effect occurs during the installation of high-voltage infeed assembly 90 into the cabinet of electrostatic precipitator 10.

Figure 3:
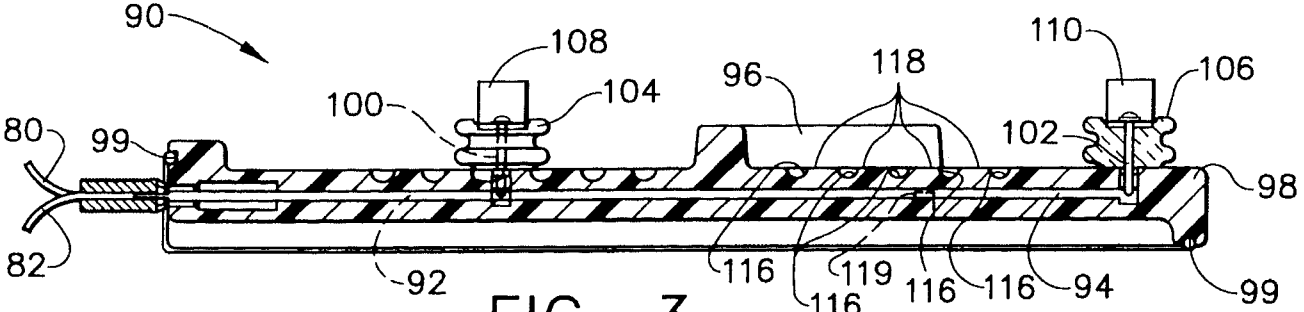
FIG. 3 is a side view in partial cross-section of the first embodiment high voltage infeed assembly depicted in FIG. 2, taken along the line 3—3.

As can be seen in FIG. 3, which is a partial section view, conductors 92 and 94 terminate at a right angle at which point the output terminal conductors 100 and 102 carry the current through an insulator 104 or 106 so that the terminals 100 and 102 can make electrical contact with a spring-loaded clip, designated by the index numerals 108 and 110, respectively, which are also made of a conductive material. The outer surface of spring clips 108 and 110 are designed to extend or bulge outwardly to press against receiving conductors (not shown) mounted along the sides of each of the cell assemblies 20 and ionizers 24. Spring-clips 108 and 110 extend or bulge outwardly to engage the receiving terminals of cell assemblies 20 and ionizers 24, but once they are actually engaged by those terminals, spring-clips 108 and 110 are depressed inwardly somewhat by those terminals, thereby insuring a good electrical connection.

As is known in the art, once the high-voltage electricity reaches such receiving conductors of the cell assemblies, it is then distributed by a common wire or busway within each of the cell assemblies 20 so that it makes electrical connection with each of the high-voltage plates of the subassembly of plates 22. Spring clips 108 and 110 of first embodiment high-voltage infeed assembly 90 are each held in place by a flat electrically conductive strip, respectively designated by the index numerals 112 and 114 (see FIG. 2), preferably by use of "tabbed" ends that are placed (at an angle) through holes in flat strips 112 and 114, then retained in place by their wider tabs within these holes. Flat strips 112 and 114 are preferably made of an electrically conducted material, however, this is not necessary for the operation of electrostatic precipitator 10.

The overall mechanical shape of the body 98 of high-voltage infeed assembly 90 is particularly designed to minimize the likelihood for electrically conductive grease to accumulate near the output terminals 100 or 102 and spring clips 108 and 110. The preferred pattern of grooves and ribs within the body 98 can be easily discerned in FIG. 2, and it will be understood that other similar patterns could be utilized for this high-voltage infeed assembly without departing from the principles of the present invention. A threaded mounting hole 119 is preferably located in the bottom wall of body 98, and two other threaded mounting holes 91 are preferably located in its end wall.

Figure 5:
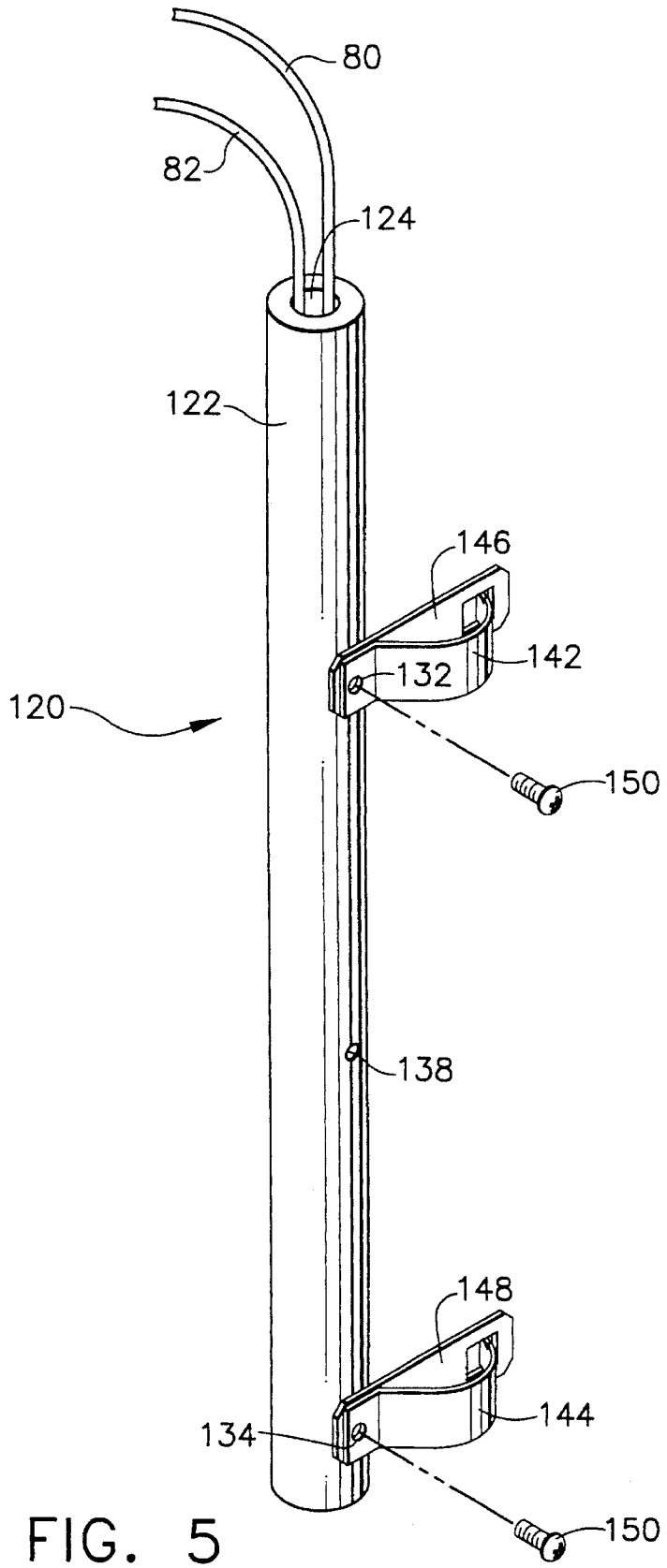
FIG. 5 is a perspective view of a second embodiment high voltage infeed assembly as used in the electrostatic precipitator depicted in FIG. 1.
Figure 6:
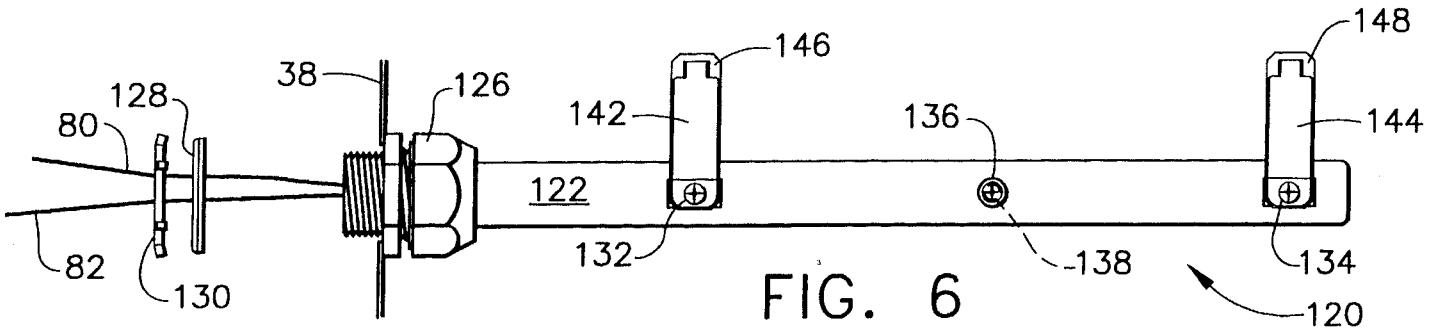
FIG. 6 is a front view of the high voltage infeed assembly depicted in FIG. 5.

A second embodiment high-voltage infeed assembly, designated by the index numeral 120, is depicted in the perspective view FIG. 5, and is preferably mounted along the inner left-wall 84 of electrostatic precipitator 10, as depicted in FIG. 1. High-voltage infeed assembly 120 comprises a main tubular body 122 that is preferably constructed of a ceramic material to reduce or eliminate the possibility of tracking between the grounded and high-voltage surfaces of high-voltage infeed assembly 120. As can be seen on FIGS. 5, 6, and 7, the high-voltage wires 80 and 82 are brought in through a top opening 124 at which location there preferably is a conduit bulkhead fitting 126, that mates with a sealing washer 128 and a lock washer 130 that hold high-voltage assembly 120 firmly with a liquid tight seal against the horizontal bulkhead 38 of electrostatic precipitator 10. Each of the wires 80 and 82 preferably are sufficiently insulated to withstand over 40,000 volts of electrical power, and are run through the hollow inner spaces of ceramic tubular body 122 until reaching their respective output terminals 132 and 134. The openings of tubular body 122 are preferably filled with an RTV compound at locations designated by the index numerals 123 and 125 which act as grease barriers.

Figure 7:
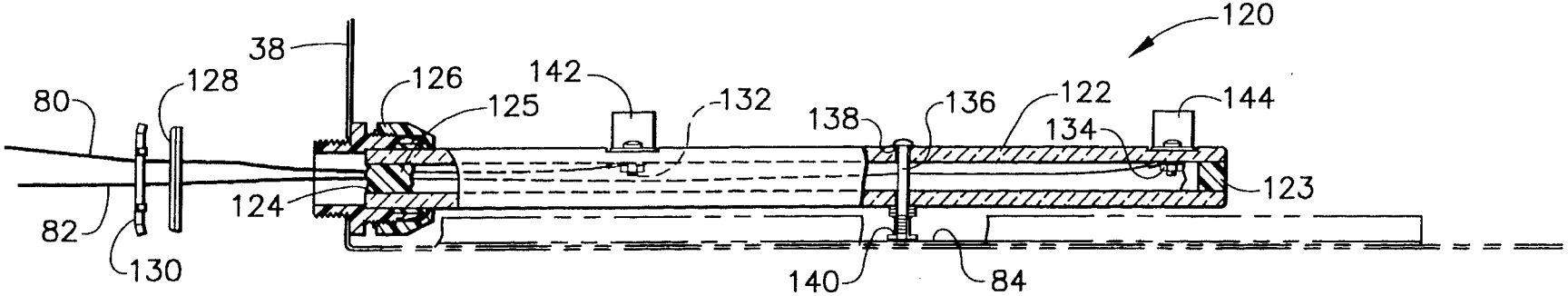
FIG. 7 is a side view in partial cross-section of the second embodiment high voltage infeed assembly depicted in FIG. 5.

Output terminals 132 and 134 preferably comprise a threaded screw with a nut (also preferably with a lock washer-not shown) and use thread-locking sealant to hold the end of each of wires 80 and 82, which in turn, are preferably connected to some type of spade connector (not shown) for ease of installation to the screw and nut assemblies that make up output terminals 132 and 134. As can be seen in FIG. 7, wire 82 extends past output terminal 132 and past a mounting screw 136 that is used to hold the bottom portion of high-voltage infeed assembly 120 to a welded threaded nut, designated by the index numeral 140. Mounting screw 136 is run through a mounting hole 138 (as seen on FIGS. 5, 6, and 7), and then engages nut 140 which is welded to the inner left-wall 84, noting that mounting screw 136 preferably has smooth side walls along its portion that sits within the interior spaces of the ceramic tubular body 122.

Since wall 84 is a grounded surface, the threaded nut 140 and mounting screw 136 are also held to ground potential, so wire 82 must still maintain its insulation level as it passes by that mounting screw 136. The outer wall of main tubular body 122 is preferably spaced-apart from the inner left-wall 84 of electrostatic precipitator 10, as shown in FIG. 7, to reduce the chances of any grease that may accumulate along the inner left-wall 84 of electrostatic precipitator 10 from touching the high-voltage conductors 142 and 144. It is preferred that conductors 142 and 144 be located as distant as possible from the horizontal wall 36, to minimize current leakage.

Output terminals 132 and 134 are electrically connected to spring-clips 142 and 144, via the respective mounting screws that comprise output terminals 132 and 134. Spring-clip 142 operates in a similar manner to spring-clip 108 of the first embodiment high-voltage infeed assembly 90, in that it is pressed against the receiving electrical conductor of each of the cell assemblies 20. Spring-clip 144 operates in a similar manner to the spring-clip 110 of the first embodiment high-voltage infeed assembly in that it presses against the receiving terminal of the ionizer 24 of each of the cell assemblies 20 (i.e., spring-clips 142 and 144 extend or bulge outwardly to engage the receiving terminals of cell assemblies 20 and ionizers 24, but once they are actually engaged by those terminals, spring-clips 142 and 144 are depressed inwardly somewhat by those terminals, thereby insuring a good electrical connection). Spring-clips 142 and 144 are preferably made of an electrically conductive material, as are output terminals 132 and 134.

As can be seen in FIG. 5, spring-clips 142 and 144 are each solidly attached at the ends held in place at output terminals 132 and 134, and are each slidably attached to flat electrically conductive rectangular strips 146 and 148, respectively, that are strong enough to withstand the forces of spring-clips 142 and 144 as they deflect. The "free" ends of spring clips 142 and 144 of second embodiment high-voltage infeed assembly 120 are each held in place by the flat rectangular strips 146 and 148, respectively, (see FIGS. 5 and 6), preferably by use of "tabbed" ends that are placed (at an angle) through holes in flat strips 146 and 148, then retained in place by their wider tabs within these holes. Flat strips 146 and 148 are preferably made of an electrically conducted material, however, this is not necessary for the operation of electrostatic precipitator 10. Strips 146 and 148 and clips 142 and 144 are preferably held in place against ceramic tubular body 122 by screws 150, which use nuts and lock washers (not shown) to prevent backing-out.

Figure 8:
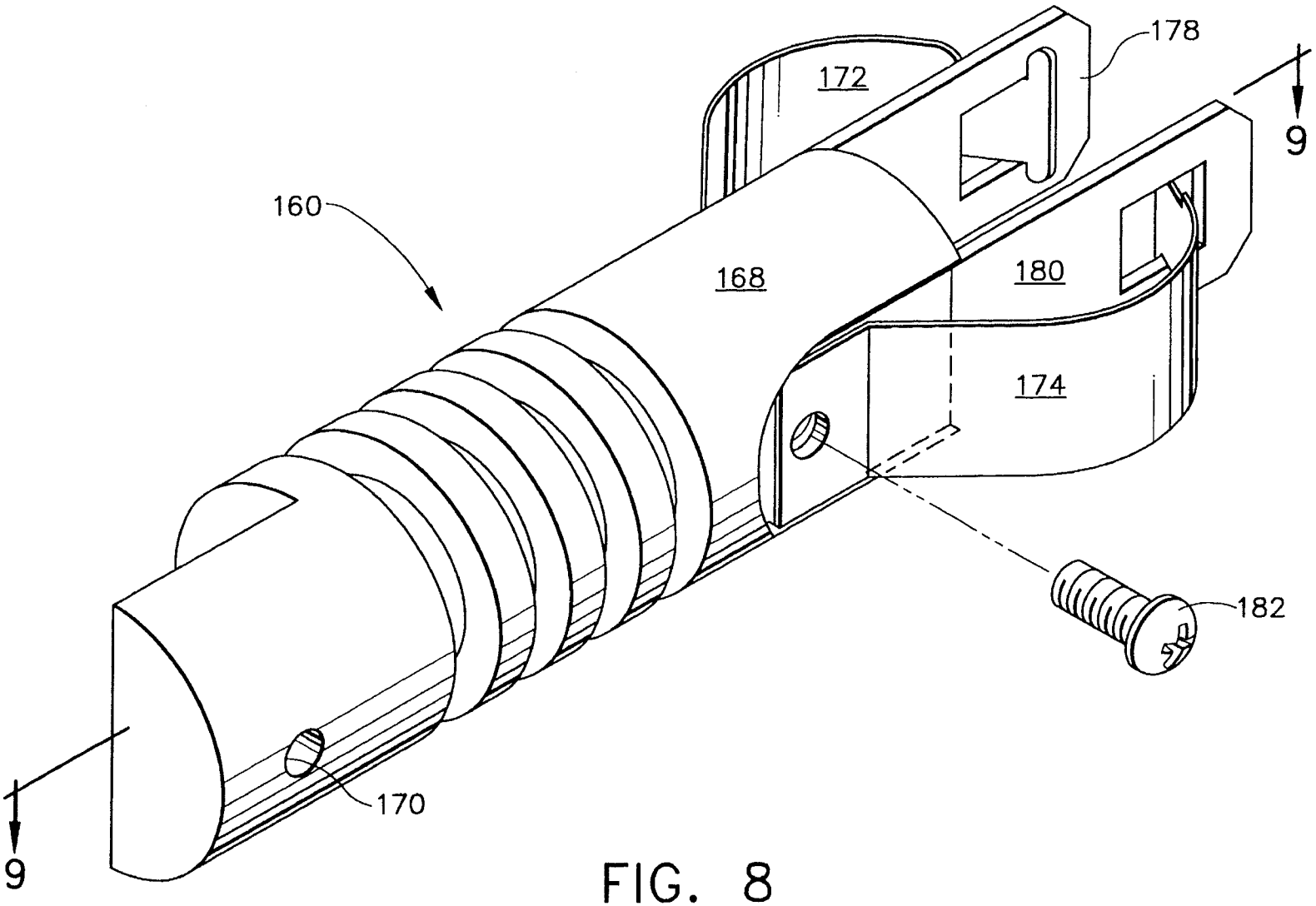
FIG. 8 is a perspective view of a cell-to-cell contact assembly as used in the electrostatic precipitator depicted in FIG. 1.

The left-most cell assembly 20 in FIG. 1 makes contact with spring clips 142 and 144 when it is positioned within its chamber or compartment 12. On the opposite side of this cell assembly 20, electrical conductors extend outward so as to make contact with another insulated assembly that will carry the high-voltage electrical power to the next cell assembly 20 within chamber 14. These electrically conductive protrusions can be seen in FIG. 1, and are designated by the index numerals 152 and 154, respectively, for carrying power from the high-voltage plates of the subassembly of plates 22 and from ionizer assembly 24. To carry this electrical power through the bulkhead 156 between chambers 12 and 14, a cell-to-cell contact assembly, designated by the index numeral 160, is provided and is depicted in the perspective view FIG. 8. Two such cell-to-cell contact assemblies 160 and 161 are mounted on bulkhead 156 so that both high-voltage electrical feeds can transfer between the cell assemblies 20 of both chambers 12 and 14.

Figure 10:
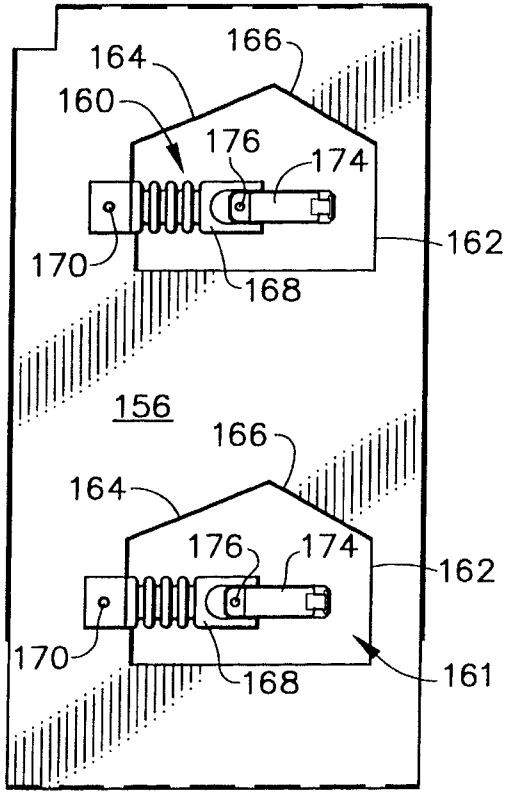
FIG. 10 is a side elevational view of a bulkhead assembly that is placed between two of the chambers or compartments of the electrostatic precipitator depicted in FIG. 1, this bulkhead assembly containing two of the cell-to-cell contact assemblies depicted in FIG. 8 and which are located within specially shaped cut-outs in the bulkhead to prevent conductive grease from falling onto the contact assemblies.

A specially shaped cut-out, designated by the index numeral 162, is utilized in bulkhead 156 to provide the required air gap to provide the necessary insulation level for these high-voltage conductors, particularly since bulkhead 156 is maintained at ground potential. As can be best seen in FIG. 10, the shape of the peripheral edges of cut-out 162 is such that any conductive grease that tends to collect along the vertical surfaces of bulkhead 156 that are located vertically above one of these cell-to-cell contact assemblies 160 will tend to be directed along the sloped edges 164 and 166 of each of the two cutouts 162 and not along the sides of the insulator portion 168 of each of cell-to-cell contact assemblies 160. Insulator portion 168 is preferably made of a ceramic material to reduce or eliminate the possibility of tracking between the grounded surfaces and high-voltage surfaces that make contact with cell-to-cell contact assembly 160. In addition, insulator portion 168 contains undulations or corrugations along its surface to increase the length that any potential leakage current must run along the outer surface of insulator portion 168, and to provide "drip points" (that do not have a flat surface where grease could accumulate).

Figure 9:
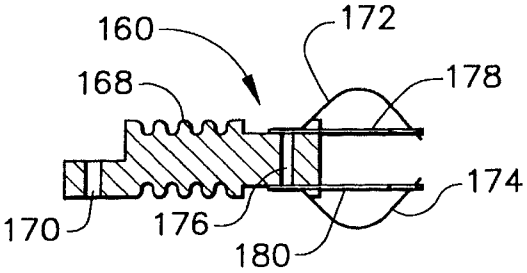
FIG. 9 is a top section view of the cell-to-cell contact assembly depicted in FIG. 8, taken along the line 9—9.

Insulator portion 168 includes a threaded mounting hole, designated by the index numeral 170. Mounting hole 170 preferably contains a threaded screw that is held in place along with a lock washer (not shown) against the flat vertical surface of bulkhead 156. On the opposite end of insulator portion 168, two spring-clips 172 and 174 (see FIGS. 8 and 9) are mounted on opposite sides of insulator portion 168, and are held in place by another screw and lock washer assembly 176 that holds spring-clips 172 and 174 against the side surfaces of insulator portion 168. Each spring-clip 172 and 174 is fixedly attached to insulator portion 168 by screw/nut assembly 176, and the spring-clips' opposite "free" ends are held in place by cut-outs in a rectangular flat piece 178 and 180, respectively, preferably by use of "tabbed" ends that are placed (at an angle) through the cut-outs in flat pieces 178 and 180, then retained in place by their wider tabs within these cut-outs. Flat pieces 178 and 180 are preferably made of an electrically conducted material, however, this is not necessary for the operation of electrostatic precipitator 10. Strips 178 and 180 and clips 172 and 174 are preferably held in place against tubular body 168 by a screw 182, which use a nut and lock washer (not shown) to prevent backing-out.

When mounted in bulkhead 156, spring clip 172 presses against and makes electrical contact with electrically conductive protrusion 152 of cell assembly 20 within chamber 12, and spring-clip 174 will press against and make electrical contact with a similar protrusion of cell assembly 20 located within chamber 14, which is not visible in the perspective view of FIG. 1. In this manner, the high-voltage electrical power is transferred from the subassembly of plates 22 from chamber 12 to similar plates 22 of chamber 14. In a similar manner, the respective spring-clips 172 and 174 of the lower cell-to-cell contact assembly 161 makes contact with the electrically conductive protrusion 154 of cell assembly 20 within chamber 12, and transfers that electrical power to a similar protrusion on the ionizer 24 of chamber 14 (not visible in FIG. 1). Spring-clips 172 and 174 extend or bulge outwardly to engage the receiving terminals of cell assemblies 20 and ionizers 24, but once they are actually engaged by those terminals, spring-clips 172 and 174 are depressed inwardly somewhat by those terminals, thereby insuring a good electrical connection. Additional cell-to-cell contact assemblies 160 are placed within cut-outs of the second bulkhead 158 to transfer high-voltage electrical power from cell assembly 20 of the middle chamber 14 to another cell assembly 20 of the right chamber 16. It will be understood that any number of chambers and bulkheads can be added to electrostatic precipitator 10 by utilizing the cell-to-cell contact assemblies 160.

It will be understood that the distance between the outer surfaces of spring-clips 172 and 174 can be manufactured for various distance requirements between the individual cell assemblies 20. For example, the mullion between the left chamber 12 and middle chamber 14 will be a greater length than the mullion between the middle chamber 14 and the right chamber 16, because of the construction arrangement in which the two doors 40 and 42 both terminate near bulkhead 156. For that reason, the dimension between spring-clips 172 and 174 of the cell-to-cell assemblies mounted on bulkhead 156 would preferably be greater than those same dimensions for the cell-to-cell assemblies mounted on bulkhead 158.

Figure 12:
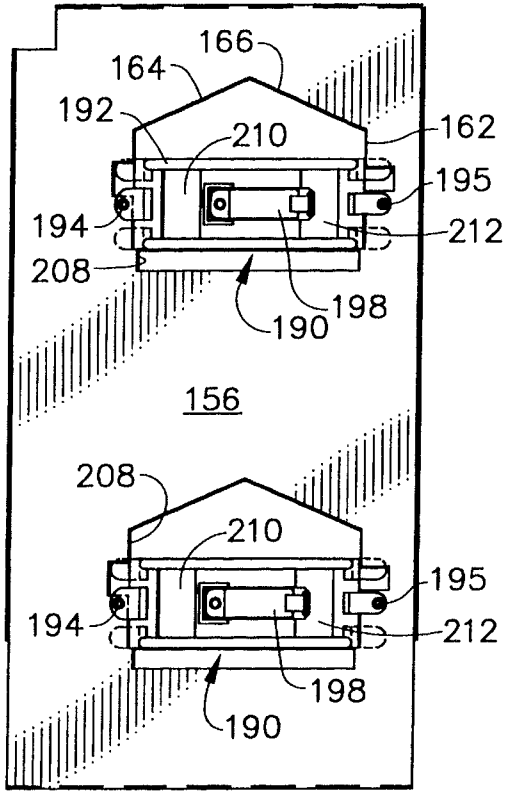
FIG. 12 is a side elevational view of a bulkhead assembly that can be used in an electrostatic precipitator constructed according to the principles of the present invention, this bulkhead assembly containing two of the second embodiment cell-to-cell contact assemblies depicted in FIG. 11 which are located within specially shaped cut-outs formed in the bulkhead.
Figure 11:
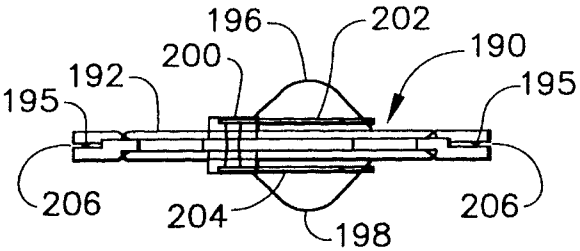
FIG. 11 is a top view of a second embodiment cell-to-cell contact assembly constructed in accordance with the principles of the present invention.

A second embodiment cell-to-cell contact assembly for carrying the high-voltage electrical power between cell assemblies 20, designated by the index numeral 190, is depicted in FIGS. 11 and 12. FIG. 12 shows two of the cell-to-cell contact assemblies 190 mounted in cut-outs 162 on a bulkhead 156, so that both high-voltage electrical feeds can transfer between the cell assemblies 20 of both chambers 12 and 14. As described hereinabove, cut-out 162 is specially shaped to provide the required air gap giving the necessary insulation level for these high-voltage conductors, and so that any conductive grease that tends to collect along the vertical surfaces of bulkhead 156 above one of the cell-to-cell contact assemblies 190 will tend to be directed along the sloped edges 164 and 166 of each of the cut-outs 162, and not along the sides of the insulator portion 192 of each of cell-to-cell contact assemblies 190. Insulator portion 192 is preferably made of a molded plastic material that is electrically insulative, to maintain the necessary insulation level.

Bulkhead 156 contains two mounting holes designated by the index numeral 194, which preferably each engage with a raised dimple 195 molded in two of the mounting "fingers" of insulator portion 192, thereby holding cell-to-cell contact assembly 190 in its proper position against the flat vertical surface of bulkhead 156. These raised dimples 195 preferably snap into their corresponding holes 194 of bulkhead 156 when properly positioned. Two spring-clips 196 and 198 (see FIG. 11) are mounted in the middle region of insulator portion 192, and are held in place by another screw and nut assembly 200 that holds spring-clips 196 and 198 against the side surfaces of insulator portion 192. Screw/nut assembly 200 fixedly attaches both spring-clips 196 and 198 at one of their ends, and their opposite "free" ends are held in place by cut-outs in rectangular flat pieces 202 and 204, respectively, preferably by use of "tabbed" ends that are placed (at an angle) through the cut-outs in flat pieces 202 and 204, then retained in place by their wider tabs within these cutouts. Flat pieces 202 and 204 are preferably made of an electrically conductive material, however, this is not necessary for the operation of electrostatic precipitator 10.

The cell-to-cell contact assemblies 190 use air gaps to increase the insulation level in areas near the live contacts (i.e., spring-clips 196 and 198), one air gap on each side of the spring-clips. These air gaps are depicted in FIG. 12 by the index numerals 210 and 212.

In the illustrated embodiment of FIG. 11, it can be seen that cell-to-cell contact assembly 190 includes a slot 206 on each of its extreme ends in which the vertical sides 208 of cut-outs 162 are placed within slots 206, as the cell-to-cell contact assembly 190 is inserted within those cut-outs. It will be understood that other mounting means could be utilized with cell-to-cell contact assembly 190 without departing from the principles of the present invention.

When mounted in bulkhead 156, spring-clip 196 presses against and makes electrical contact with the electrically conductive protrusion 152 of cell assembly 20 within chamber 12, and spring-clip 198 will press against and make electrical contact with a similar protrusion of cell assembly 20 (not shown) located within chamber 14. Spring-clips 196 and 198 extend or bulge outwardly to engage the receiving terminals of cell assemblies 20 and ionizers 24, but once they are actually engaged by those terminals, spring-clips 196 and 198 are depressed inwardly somewhat by those terminals, thereby insuring a good electrical connection. In this manner, the high-voltage electrical power is transferred from the sub-assembly of plates 22 from chamber 12 to similar plates 22 of chamber 14. Additional cell-to-cell contact assemblies 190 are placed within cut-outs of the second bulkhead 158 to transfer high-voltage electrical power from cell assembly 20 of the middle chamber 14 to another cell assembly 20 of the right chamber 16. It will be understood that any number of chambers and bulkheads can be added to electrostatic precipitator 10 by utilizing the cell-to-cell contact assemblies 190.

Figure 14:
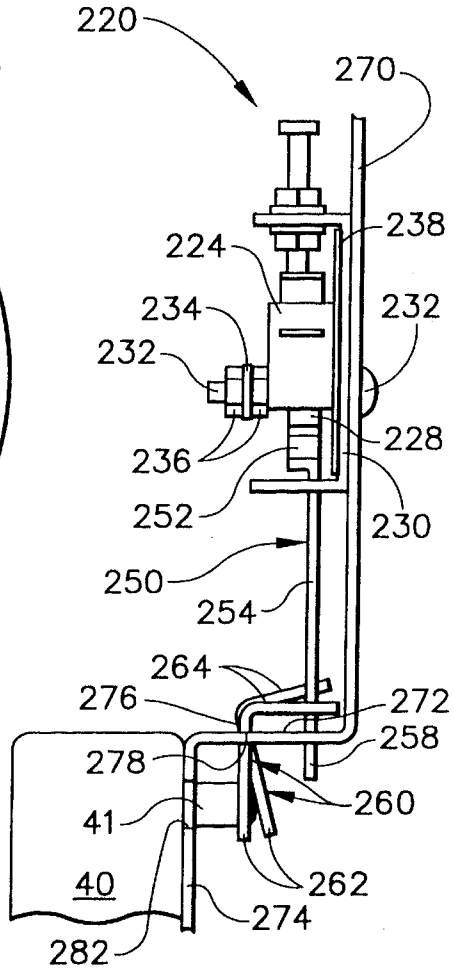
FIG. 14 is an end elevational view of the safety limit switch assembly depicted in FIG. 13.
Figure 13:
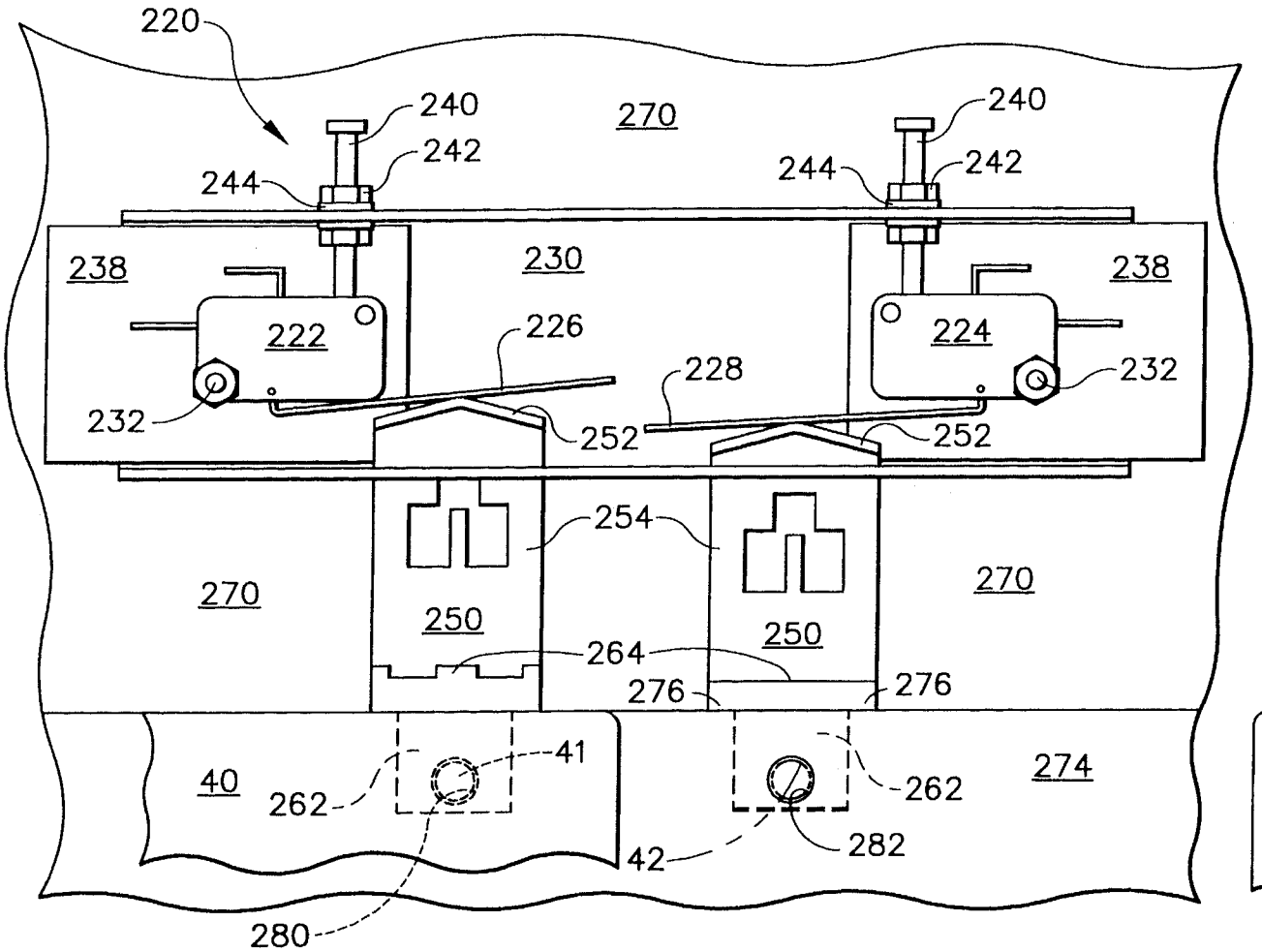
FIG. 13 is a side elevational view of a safety limit switch assembly used to detect the opening of either door of the electrostatic precipitator depicted in FIG. 1.

Although high-voltage power supply 46 limits its total output current to a maximum of 4.5 mA and is therefore considered non-lethal, it is obviously desirable to prevent human beings from being exposed to the high voltages that exist during operation of electrostatic precipitator 10, and it is preferred that some type of electro-mechanical door interlock mechanism or safety limit switch assembly be employed to shut down the high-voltage power in the event that either door 40 or 42 is opened during such operation. An important safety feature of electrostatic precipitator 10 is the electro-mechanical door interlock that shuts the high-voltage power off to the cell assemblies 20 if either one of the doors 40 or 42 are opened during operation. This electro-mechanical door interlock is generally depicted by the index numeral 220, and is best viewed in FIGS. 13 and 18. In FIG. 13, electro-mechanical door interlock 220 includes two safety limit switches 222 and 224, and these limit switches are commonly available as a part number V3L-1588-D8 manufactured by Honeywell Corporation, located at 11 West Spring Street, Freeport, Ill. 61032. As can be seen in FIG. 14 (an end view), the electro-mechanical door interlock 220 is designed to occupy only a minimal amount of depth so as to not interfere with other components of the system within the fascia 36, particularly the hood 32 and other nearby components.

Figure 17:
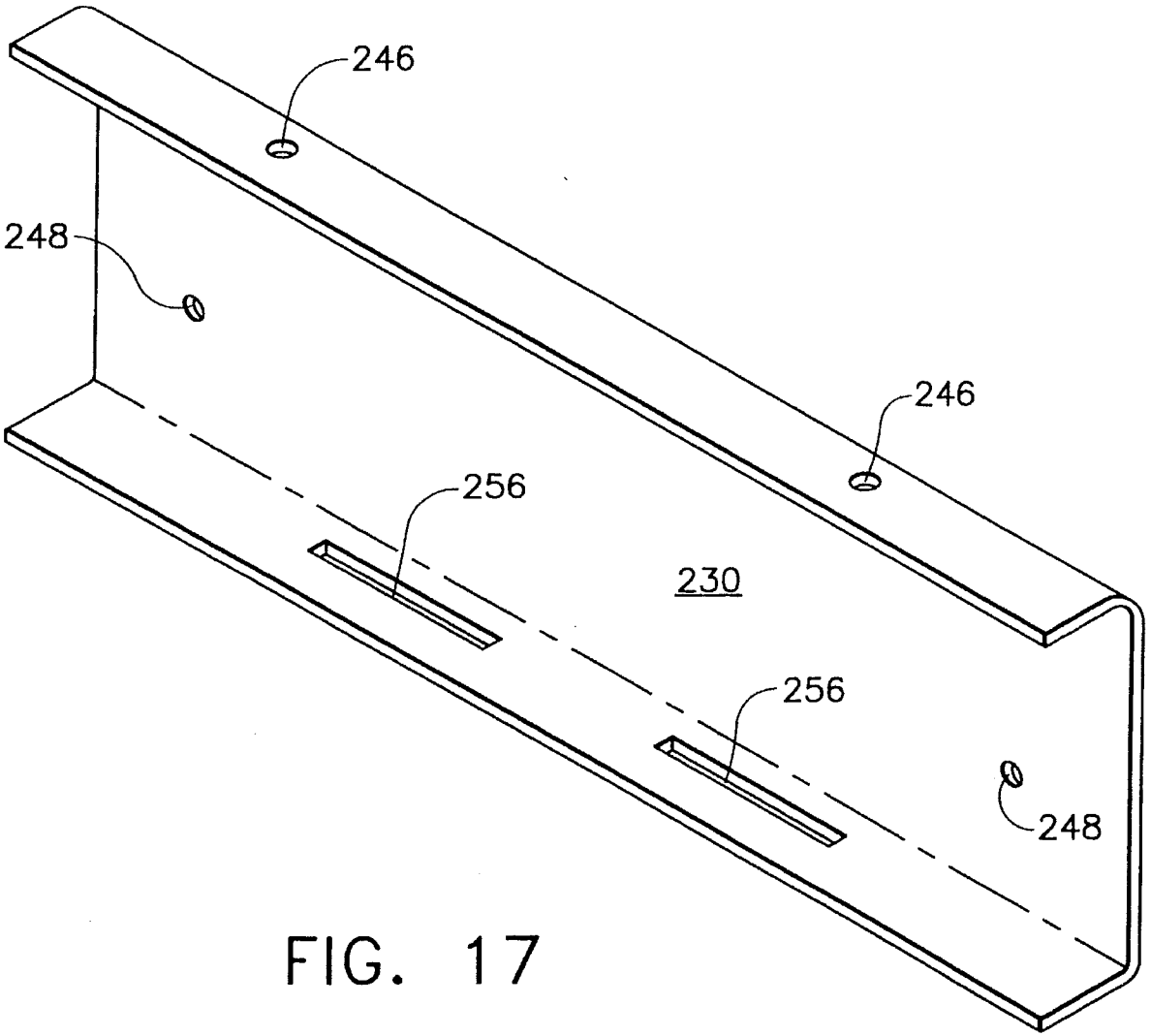
FIG. 17 is a perspective view of the switch channel used in the safety limit switch interlock assembly depicted in FIG. 13.

In FIG. 13, the actuating arm 226 of limit switch 222 is in its normal, operating position, indicating that its associated door (i.e., door 40) is presently closed. The operating arm 228 of limit switch 224, on the other hand, is in its non-safe position, indicating that the door associated with that limit switch (i.e., door 42) is presently open. Limit switches 222 and 224 are both mounted upon a switch channel or mounting rail designated by the index numeral 230, and best viewed in FIG. 17. As can be seen in the exploded perspective view of FIG. 18, both limit switches 222 and 224 are each mounted to switch channel 230 by use of a threaded stud or screw 232, lock washer 234, and a pair of nuts 236. In addition, a sheet of insulating paper designated by the index numeral 238 is preferably mounted between each limit switch 222 or 224 and the switch channel 230. The above screws and nuts are all preferably made of metallic materials. Studs (or screws) 232 are held in place through openings 248 in switch channel 230.

Figure 16:
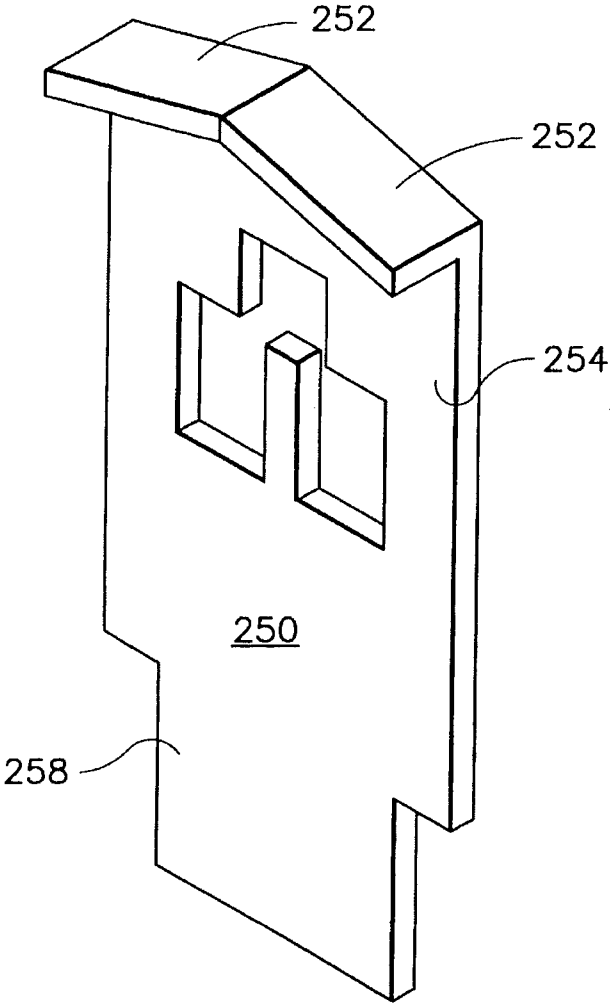
FIG. 16 is a perspective view of the pusher strip used in the safety limit switch assembly depicted in FIG. 13.
Figure 18:
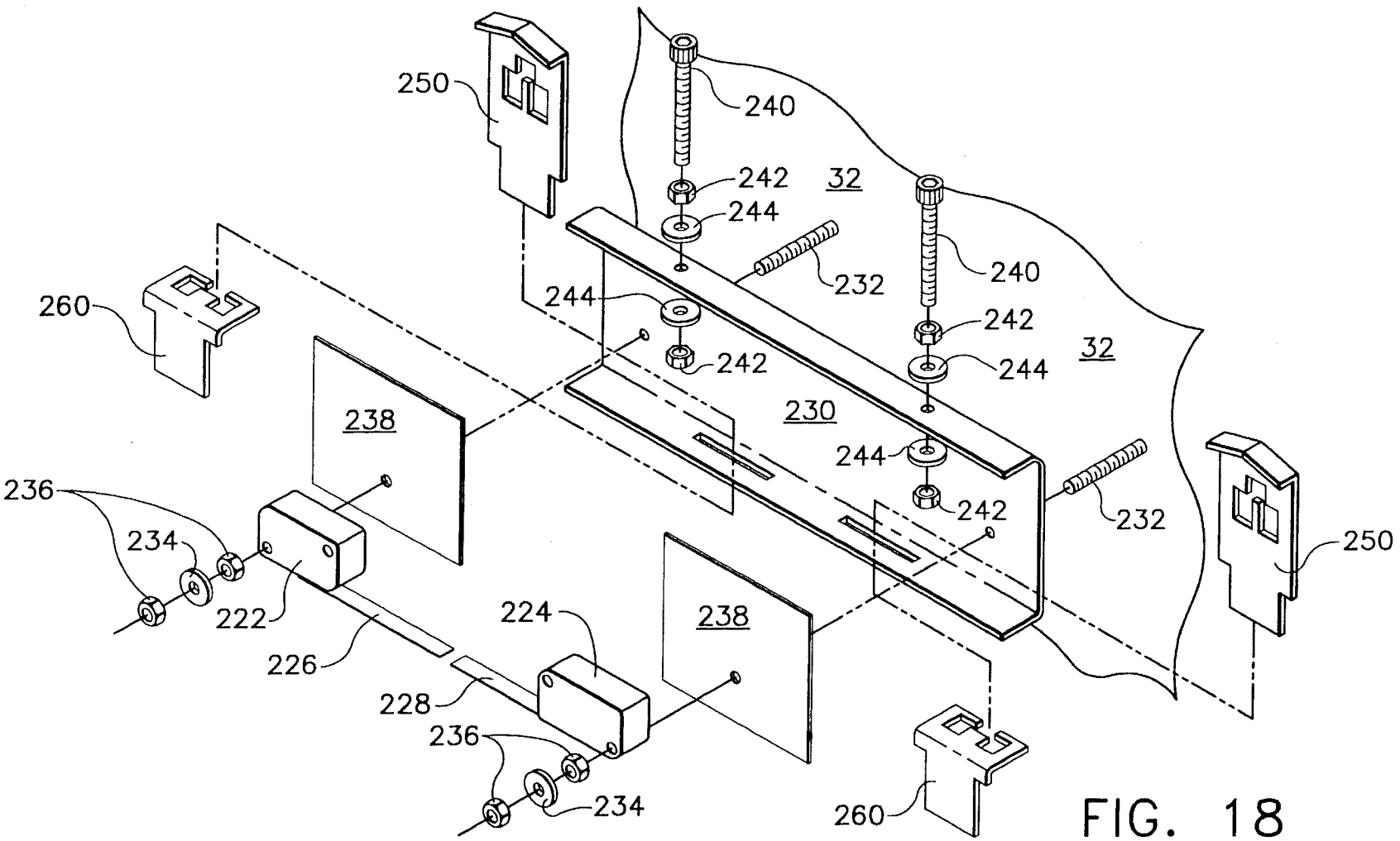
FIG. 18 is an exploded perspective view of the safety limit switch assembly depicted in FIG. 13.

Limit switches 222 and 224 are preferably provided with an adjustment feature, which, in the illustrated embodiment of FIGS. 13 and 18, comprises a NYLON™ machine screw designated by the index numeral 240. Using NYLON™ screws 240, the position of limit switches 222 and 224 can be rotationally adjusted. Screws 240 are held in place by nuts 242 and lock washers 244, and pass through openings 246 in switch channel 230. Operating arms 226 and 228 are independently placed into contact with an individual pusher strip designated by the index numeral 250. Each pusher strip 250 has an upper actuating region 252 that is designed to contact one of the operating arms 226 or 228, a mid-portion 254 having a width that is narrower than the length of the slots 256 in switch channel 230, and a lower portion 258 that is yet narrower than the mid-portion 254. These features of pusher strip 250 are best viewed in FIG. 16.

Figure 15:
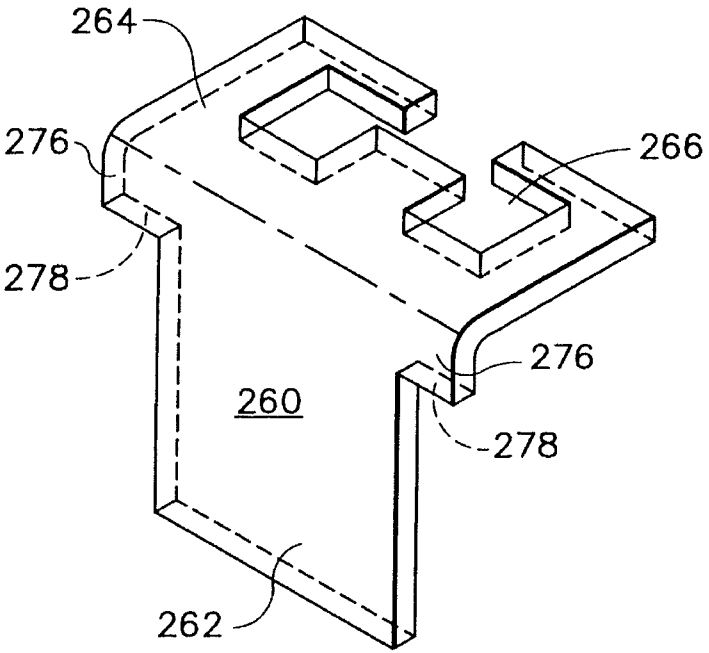
FIG. 15 is a perspective view of the switch lever used in the safety limit switch assembly depicted in FIG. 13.

Pusher strip 250 is actuated by a switched lever 260, which has the appearance of an angled L-bracket in which its vertical portion 262 extends downward toward one of the doors 40 or 42, and its horizontal portion 264 which contains a specially shaped slot 266 through which the lower portion 258 of pusher strip 250 passes through. These features are best viewed in FIG. 15. In addition, switched lever 260 includes an upper, "wider" portion 276 of the vertical portion 262 that has a bottom surface 278. This bottom surface 278 engages against a horizontal wall portion 272 of the stationary structure of hood region of electrostatic precipitator 10, and can be best viewed in FIGS. 14 and 15, in which it can be seen that slot 266 provides only a relatively "narrow" gap (in one of the horizontal directions) through which pusher strip 250 protrudes.

The front wall 270 of hood 32 extends downward and makes a right-angle bend to form this horizontal wall portion 272, after which it makes another right-angle bend to form a lower vertical wall portion 274. When switched lever 260 is either pushed inward by one of the doors 40 or 42 or is allowed to remain in its "relaxed" position, the bottom surface 278 engaging against horizontal wall portion 272 acts as a pivoting point (see FIG. 14) as its vertical portion 262 moves essentially in the horizontal plane, and as its horizontal portion 264 moves essentially in the vertical plane (thereby raising pusher strip 250—see paragraph below for greater detail).

As can be seen in the assembly drawing FIG. 13, when door 40 is closed, a dowel 41 protruding from the rear of door 40 (and through a hole 280 in vertical wall portion 274) pushes against the vertical portion 262 of switched lever 260 (i.e., the switched lever on the left as seen in FIG. 13), and tends to push the horizontal portion 264 of switched lever 260 to its upward (uppermost) position. This in turn, by the action of the horizontal portion 264 of switch lever 260, pushes the mid-portion 254 of pusher strip 250 toward its upward or uppermost position, thereby engaging via the upper-actuating region 252, the operating arm 226 of limit switch 222 and raising it to its upper or actuated position. In this position, this portion of electro-mechanical door interlock 220 indicates that the door is closed in its "safe" position, and indicating that it is safe to operate the electrostatic precipitator 10, insofar as the left chamber or compartment 12 is concerned.

The other (right-hand in FIG. 13) switched lever/pusher strip/limit switch arm combination is depicted in the opposite (open) position, namely because its door 42 is not in its closed position. When door 42 is open, its dowel 43 (not shown in FIG. 14) is not engaging the vertical portion 262 of switched lever 260 (i.e., the switched lever on the right as seen in FIG. 13), and the horizontal portion 264 of switched lever 260 falls to its lowermost position (because of gravity), thereby allowing pusher strip 250 to fall to its lowermost position (also because of gravity), and this lower position is only limited by the upper-actuating region 252 engaging the lower rail of switch channel 230. In this position, the operating arm 228 of limit switch 224 is allowed to fall to its opposite, lower or bottom position, indicating that door 42 is open and that it is not safe to operate electrostatic precipitator 10. It is preferred that both limit switches 222 and 224 be in their "safe" positions before high-voltage power is allowed to be applied to any of the cell assemblies 20. If door 42 is closed, then its dowel 43 will protrude through a hole 282 in vertical wall portion 274 and against the vertical portion 262 of switched lever 260 (i.e., the switched lever on the right as seen in FIG. 13).

As can be seen in the drawings and in the above description, electro-mechanical door interlock 220 only uses one fastener (i.e., stud or screw 232) per limit switch 222 or 224, and pusher strips/switched lever assembly. All of the other parts (i.e., pusher strip 250 and switched lever 260) are maintained in their respective proper positions by use of their shapes in fitting through specially designed slots (i.e. slots 256 and 266). This not only simplifies the assembly of electro-mechanical door interlock 220, but provides less means for failure at a later date in the operation of electro-mechanical door interlock 220. It will be understood that the exact shapes and sizes of the various components of electro-mechanical door interlock 220 can be modified without departing from the principles of the present invention.

High-voltage power supply 46 requires line power (depicted by the index numeral 302 on FIG. 19) for its operation, and line power 302 is connected to an input stage 300. The input stage of convention power supplies typically includes a transformer and a rectifier, however, in high-voltage power supply 46 it is preferred that input stage 300 consists mainly of a rectifier without any type of transformer so that the line power of 120 volts AC, 50/60 Hertz, single phase or 230 volts AC, 50 Hertz, single phase be immediately rectified into direct current.

The DC voltage output by this rectifier of input stage 300 is directed into a switching oscillator stage 304, which includes a conventional oscillator element of a switching power supply and converge the direct current into a 40 kHz alternating current, which is output at arrow 306. This 40 kHz alternating current is directed into a combined high-voltage stage and output stage, generally depicted by the block having the index numeral 308.

Block 308 includes a high-voltage transformer, an intermediate stage that includes voltage multipliers and a rectifier utilizing capacitors and diodes as in a convention power supply, and includes a final output stage that provides two different output voltages $V_{OUT1}$ and $V_{OUT2}$ at arrows 310 and 312. High-voltage output $V_{OUT1}$ is directed to the ionizers 24 of electrostatic precipitator 10, and preferably has a high-voltage magnitude of 11 kV. The second high-voltage output $V_{OUT2}$ is directed to the collector plates 22 of the cell assemblies 20 of electrostatic precipitator 10, and preferably has the high-voltage magnitude of 6 kV.

High-voltage/output stage 308 also includes a voltage sensing line that continuously detects the voltage magnitude of the ionizer's $V_{OUT1}$ voltage 310, and inputs that value as a $V_{SENSE}$ signal 314 which is input into the switching oscillator stage 304 so that high-voltage power supply 46 can automatically compensate for variations in load and in line voltage, as in a conventional switching power supply. High-voltage/output stage 308 also outputs a current sense signal, generally depicted by the term $I_{SENSE}$, which preferably is proportional to the magnitude of the combined current being drawn by both outputs 310 and 312 to the ionizer and collector plates of electrostatic precipitator 10. Signal $I_{SENSE}$ is preferably converted into a voltage value by use of a resistor $R_1$, and is directed into an operational amplifier (op-amp) 318, as an input at arrow 316.

The output of op-amp 318, generally designated by the index numeral 320 and designated $V_D$, has a magnitude that is proportional to the total current being supplied from the combined outputs 310 and 312 of electrostatic precipitator 10. This voltage signal $V_D$ on FIG. 19 corresponds to the analog value of the variable "D" depicted on the flow chart in FIG. 20.

High-voltage power supply 46 includes three voltage comparators designed by the index numerals 322, 334, and 344, and includes two timers 326 and 348 and three LEDs with corresponding driver circuits. The LEDs are designated by the index numerals 332 ("yellow"), 352 ("red"), and 358 ("green"), and their corresponding driver circuits are designated by the index numerals 328, 340, 350 and a logically inverted driver circuit 356.

Figure 19:
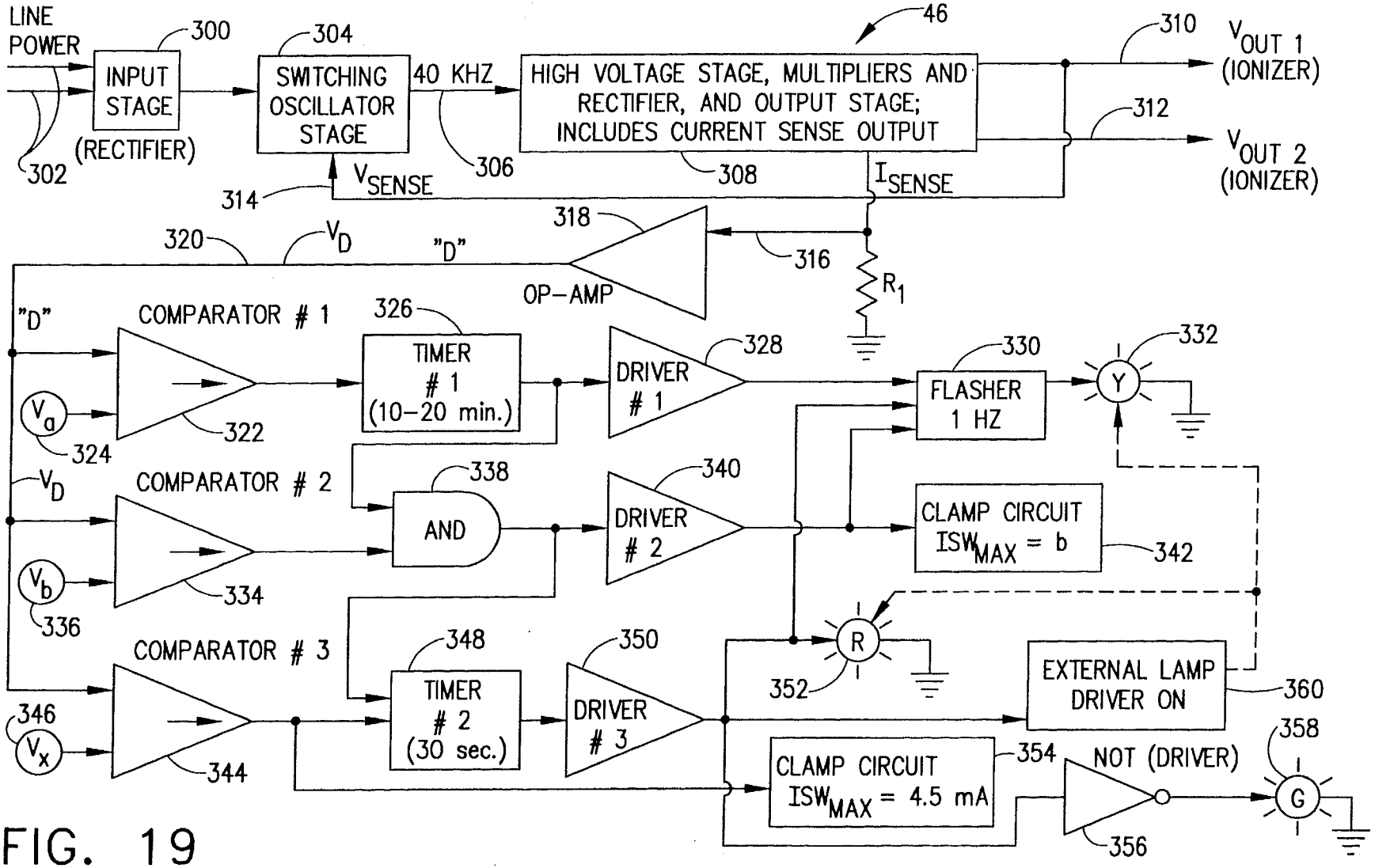
FIG. 19 is a block diagram of a high-voltage power supply used in the electrostatic precipitator depicted in FIG. 1.
Figure 20:
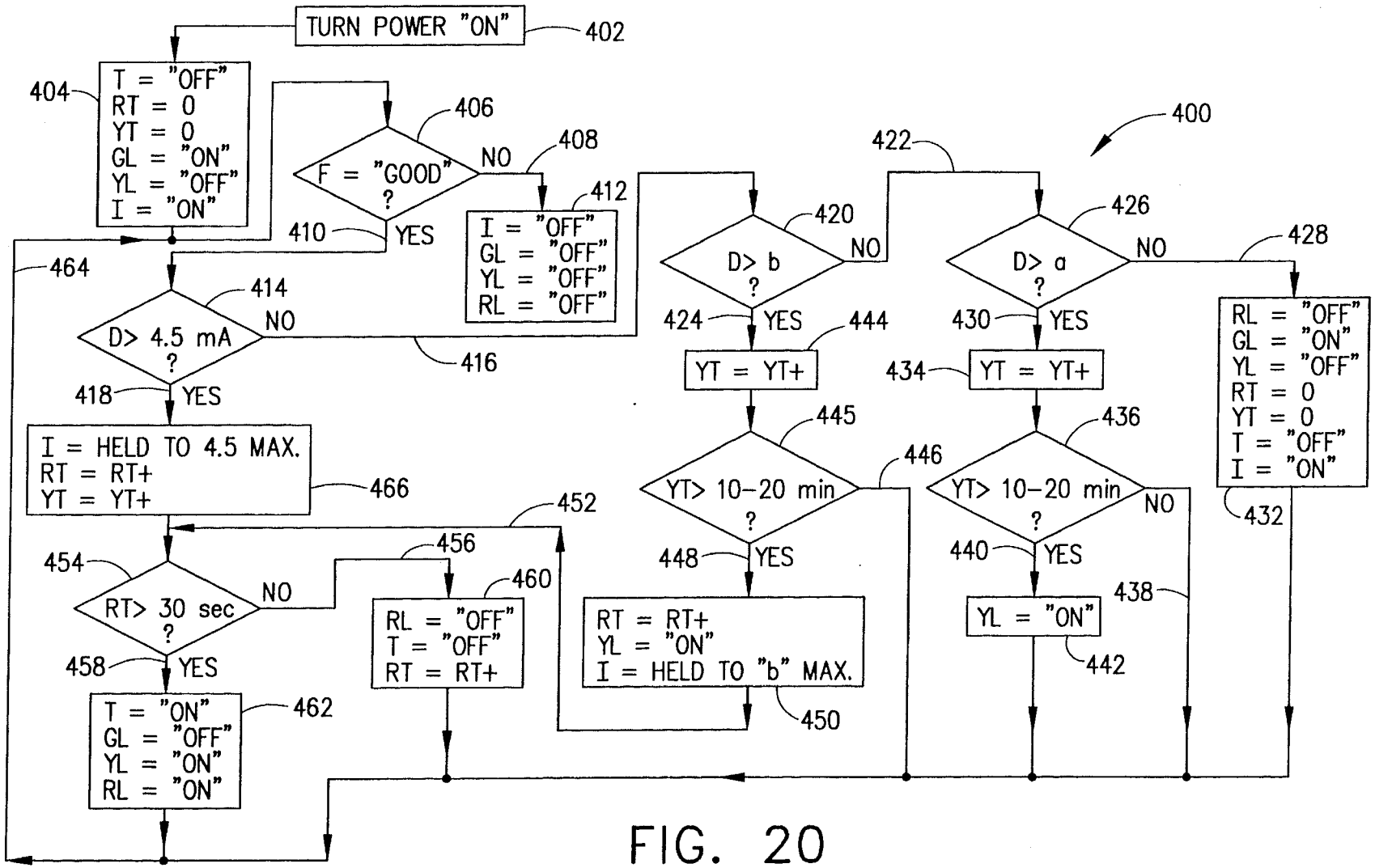
FIG. 20 is a flow chart depicting the operation of the high-voltage power supply of FIG. 19.

To understand the operation of these comparators, timers, and drivers, a flowchart 400 on FIG. 20 is consulted which describes the logical operations. The first step of logic flow-chart 400 is the initialization step 402 in which power is first turned on. As part of the initialization process, a function block 404 is encountered in which certain variables and physical devices are given their initial operation states as follows: "T" (the external lamp driver circuit) is set to OFF, timer "RT" (the "red" timer, also known as timer #2 or block 348 on FIG. 19) is set to a value of zero, timer "YT" (the "yellow" time also known as timer #1 or block 326 on FIG. 19) is set to zero, "GL" (the "green" LED) is turned ON, "YL" (the "yellow" LED) is set to OFF, "RL" (the "red" LED) is set to OFF, and "I" (the output current switch) is turned ON. A chart is provided on FIG. 21 that provides information concerning the variable names used in flow chart 400 (on FIG. 20).

A decision block 406 is encountered next on logical flow-chart 400 where it is determined if the fuse (not shown) is "good." If the answer is "NO" then the logic flow travels along arrow 408 to function block 412 in which output current switch I is turned OFF and all three LEDs (GL, YL and RL), are turned OFF. If this indeed occurs, then the fuses are "blown," and power supply 46 will not begin operation.

If decision block 406 determines that the fuses are "good", then the logic flow follows the YES decision arrow 410 to another decision block 414 which asks the question if the total current demand presently has a value greater than 4.5 mA. The means for making this decision is comparator #3, designed by the index number 344 on FIG. 19. A voltage reference signal $V_X$, depicted by the index numeral 346, is used as one of the inputs to comparator #3, and its other input is the signal $V_D$. Both signals $V_D$ and $V_X$ are analog voltage values, and the output of comparator #3 is a digital value that is input into timer #2 (block 348 on FIG. 19). In an actual hardware circuit, the output of comparator #3 would be configured to start timer #2 when signal $V_D$ exceeded the magnitude of signal $V_X$.

The output of comparator #3 is preferably configured to start the timing function of timer #2 only if decision block 414 created a YES answer along arrow 418 in flow chart 400. If the answer of decision block 414 is NO, then timer #2 would not be placed into its running state and the logic flow would follow arrow 416 to another decision block 420.

Decision block 420 determines whether or not the total current demand 46 is greater than a value depicted by the letter "b". The value for "b" is dependent upon how many cell assemblies 20 are built into electrostatic precipitator 10, because each extra cell will add to the current burden that must be supplied by high-voltage power supply 46. A three position switch (not shown) can be installed within power supply 46, a jumper block could be installed, or a given power supply 46 can be hard-wired to be used only for a one-cell, two-cell, or three-cell electrostatic precipitator assembly. A second chart is provided on FIG. 21 that shows the preferred values for the current limit threshold "b" as well as a second, lower current limit threshold "a," discussed in detail hereinbelow.

Decision block 420 is accomplished in hardware by a voltage comparator, namely, comparator #2 on FIG. 19, which accepts as its analog inputs the signal $V_D$ and threshold voltage signal $V_b$, designated by the index numeral 336. If the total current demand is greater than "b" on FIG. 20, corresponding to signal $V_b$, then decision block 420 will output a signal along its YES logic flow line, i.e. arrow 424, to start a timer via function block 444. In hardware, this is timer #1, or block 326 on FIG. 19, which would already be running since the threshold value "b" is always greater than "a," and timer #1 would have been started by comparator #1. If the present current is less than or equal to the value "b," then decision block 420 will direct the logic flow along its NO arrow 422, thereby reaching decision block 426.

Decision block 426 determines whether or not the total current demand is presently greater than the value "a" which, as in the case of the value "b", depends upon how many cells assemblies there are within electrostatic precipitator 10. The preferred values for "a" are given in the second chart on FIG. 21. If the present current demand exceeds the value for "a," then decision block 426 will direct the logic flow to its YES output along arrow 430 to a timer function block 434. If the present current value is less than or equal to the value for "a," then decision block 426 will direct the logic flow to its NO output, along arrow 428.

In hardware, decision block 426 is accomplished by comparator #1, designated by the index numeral 322 on FIG. 19. Comparator #1 accepts as inputs the analog voltage signal $V_D$, and a threshold voltage signal $V_a$, designated by index numeral 324. Comparator #1 outputs a digital or Boolean signal to the input of timer #1, which is block 326 on FIG. 19. Timer #1, when active, (i.e., when timing) performs the function block 434 on FIG. 20. This is the "yellow" timer and accumulates time using the variable YT on flow chart 400. Timer #1 will actually perform its timing function only if decision block 426 determines if the total current demand is greater than "a." Otherwise, timer #1 remains dormant, and the logic flow, via arrow 428, leads to a function block 432 which sets a number of logic states and timing states to the "normal" values, meaning that all is well with respect to the voltage and current levels being provided by high-voltage power supply 46. Function block 432 causes the red LED 352 to stay OFF, the green LED 358 to be ON, and the yellow LED 332 to also remain OFF. In addition, function block 432 sets both timing variables RT and YT to the value zero, keeps the external lamp driver "T" OFF, and allows the output current switch "I" to remain ON.

The purpose of having LEDs of different colors is to provide the equipment operator with an indication as to whether or not the collecting plates of the cell assemblies 20 are becoming dirty by accumulating a certain amount of grease flowing through electrostatic precipitator 10. As this conductive grease accumulates, it begins to draw a certain amount of leakage current from the high voltage conductors to the grounded conductors, and this leakage current must be supplied by high-voltage power supply 46.

As long as the current demand is less than the value "a," electrostatic precipitator 10 does not need to have its collector plates cleaned. Once the total current demand becomes greater than the value "a," then the yellow LED is turned ON (in a flashing mode) to alert the equipment operator to the need for cleaning the collecting plates of cell assemblies 20. This is accomplished in flow chart 400 by decision block 436, which determines whether or not the "yellow" timer, (i.e. timer #1) has been continuously running for more than a time interval preferably within the range of ten to twenty minutes. If the answer is NO, then decision block 436 outputs the logic flow along arrow 438, thereby taking no action with respect to changing the state of any of the LEDs. As can be seen in flow chart 400, the logic flow then returns via line 464 back to a point near the beginning of the decision making process of this logic flow chart, i.e., at decision block 406 where the fuse is tested.

It will be understood that logic flow chart 400 could be implemented by a sequential device such as a microprocessor, and logic flow line 464 would simply be a return branch to the beginning of a subroutine, or other software routine. It will be further understood that logic flow chart 400 could be accomplished in parallel logic, which is the preferred method for accomplishing the tasks described herein, and a hardware representation of this parallel logic is described in block diagram form in FIG. 19.

If decision block 436 determines that the "yellow" timer, (timer #1) has been timing continuously for more than the time interval in the range of 10–20 minutes, then it will direct the logic flow along its YES output, arrow 440, to a function block 442 that turns the yellow LED ON. This is accomplished in hardware by the output of timer #1 (block 326), which is an ON-delay timer having a preferred timing value in the range of ten to twenty minutes. The output of timer #1 is directed into a first driver circuit 328, which directs its output to a flasher circuit 330. Flasher circuit 330 merely toggles the current to the yellow LED 332, preferably at a rate of between ½ to 1 Hertz. In this way, the flashing light will more likely attract the attention of the equipment operator.

In this state, high-voltage power supply 46 can safely continue to operate, because the present total output circuit cannot start a fire even at the present leakage level through the conductive grease. Of course, now that the yellow LED is flashing, the equipment operator is supposed to perform preventive maintenance by cleaning the cell assemblies 20 sometime in the near future, but the cleaning need not be performed immediately. It will be understood that the values for "a" and "b" would likely vary considerably for different hardware configurations of collector plates and ionizer assemblies for cell assemblies 20. It will further be understood that the conductivity of the grease being used in the french fryer below the electrostatic precipitator 10 is very important in determining the current limit values for "a" and "b".

If a new batch of frozen french flies were to be added to the french fryer beneath electrostatic precipitator 10, the extra humidity released would likely temporarily increase the leakage current demand being supplied by high-voltage power supply 46, due to the suddenly high humidity atmosphere. Even with the yellow LED flashing in the mode described above, it is unlikely that the total current demand will increase to the point where its value will be greater than "b." If it does not increase to a value greater than "b," then the yellow LED will continue flashing, but no other action will be taken by high-voltage power supply 46.

As more grease accumulates on the collector plates of the cell assemblies 20, the leakage current will further increase to where the total current demand will ultimately exceed the value "b." When this occurs, decision block 420 will direct the logical flow through its YES output along arrow 424, thereby starting the timing of the yellow timer (if not already started at function block 434) via function block 444. Remembering that the yellow timer is timer #1, it may have already timed out via decision block 426, function block 434, and decision block 436 if the total current demand had already exceeded "a" continuously for more than the time interval in the range of 10–20 minutes. Decision block 445 will evaluate whether or not the yellow timer (i.e., timer #1) has indeed timed out yet, and if the answer is NO, it will direct the logic flow along arrow 446, which returns the logic flow along the return branch 464. If the answer is YES, decision block 445 will direct the logic flow along arrow 448 to function block 450.

In hardware, this flow chart logic, starting with decision block 420 and continuing along function block 444 and decision block 445, is equivalent to comparator #2 (i.e., index numeral 334), voltage reference $V_b$ (i.e., signal 336), and the output of comparator #2 directed into an AND-gate 338. It will be understood that an additional, separate timer could be supplied on the output of comparator #2 (rather than using the same timer #1 that receives the output of comparator #1 along with the AND-gate 338) and achieve essentially the same logical operation of this portion of high-voltage power supply 46.

Function block 450 causes the "red" timer (i.e., timer #2) designated by the index numeral 348 on FIG. 19 to run, turns the yellow LED 332 ON, and causes the output current switch to be held to the value of "b." This is accomplished in hardware (as depicted in FIG. 19) by the output of AND-gate 338 driving into the input of (another) driver circuit #2, depicted by the index numeral 340, which further drives the yellow LED 332 ON via flasher circuit 330. The output of driver #2 also drives into a clamping circuit 342 which holds the output current switch to a maximum value equal to "b."

The logic flow is output from function block 450 along an arrow 452 and arrives at a function block 454 which determines whether or not the "red" timer (i.e., timer #2 at block 348 on FIG. 19) has been active continuously for greater than 30 seconds. This is accomplished in hardware by the output of AND-gate 338 being directed into the input of timer #2 at block 348. If the decision made by decision block 454 is NO, then the logic flow is directed along arrow 456 to a function block 460 which keeps the red LED 352 OFF, keeps the external lamp driver OFF, and allows the red timer #2 to continue to run. The logic flow then continues along the return branch 464.

On the other hand, if timer #2 does time continuously for more than 30 seconds, decision block 454 will direct the logic flow to its YES output along arrow 458 to function block 462. When this occurs, the external lamp driver circuit, designated by the index numeral 360, is turned ON, the green LED 358 is turned OFF, the yellow LED 332 still flashes ON and the red LED 352 is turned ON. This is accomplished in hardware by the output of timer #2 being directed to a (third) driver circuit #3, designed by the index numeral 350, which has its output directed to the red LED 352, and to a logic inverter or NOT-gate 356, which in turn drives the green LED 358. As can be seen from the block diagram, the green and red LEDs are opposites in the Boolean algebra sense.

In the condition described in the previous paragraph, the total output current has become great enough that the equipment operator should take immediate action to clean the collecting plates of the cell assemblies 20. When the total current demand is this great (greater than the value of b), then there is enough leakage current that a fire could develop among the conductive grease that has been accumulated by electrostatic precipitator 10. The situation, however, is not an emergency at this time, otherwise the operation of electrostatic precipitator 10 would be shut down immediately. In the illustrated embodiment, if the timer 326 (i.e., timer #1) times out after an interval in the range of 10–20 minutes of continuous excess current (greater than "b"), then the current switch "I" will turn on at the value of "b" and clamping circuit 342 will prohibit the output current from exceeding a value equal to "b", and the total output current will never reach the otherwise maximum of 4.5 mA. In this condition, clamping circuit 342 limits the total output current at outputs $V_{OUT1}$ and $V_{OUT2}$ to "b", which ultimately causes the compliance voltage at outputs $V_{OUT1}$ and $V_{OUT2}$ to fall to a level at which the ionizer and collecting plates cannot properly operate.

If the total current demand continues to increase to a level above 4.5 mA (during the 10–20 minute ON-delay time period of timer #1 via blocks 444, 445, and 450), then decision block 414 will direct the logic flow along arrow 418 to a function block 466 which causes both the red and yellow timers to time, and which holds the output current to 4.5 mA maximum. The logic flow from decision block 414 to function block 466, and further to decision block 454 and function block 462 is accomplished in hardware starting with comparator #3, designated by index numeral 344 on FIG. 19. Comparator #3 accepts the analog voltage signal $V_D$ and threshold voltage signal $V_X$, designated by index numeral 346. The output of comparator #3 is a logic or Boolean signal that drives into timer #2, which is an ON-delay timer (block 348 on FIG. 19) and preferably has an ON-delay interval of 30 seconds, as per decision block 454. Timer #2 outputs into driver circuit #3, which then turns on the red LED 352, and also the yellow LED 332 via its flasher circuit 330. Driver circuit #3 also turns off the green LED 358, via NOT-gate 356. In addition to the above, comparator #3 sends an additional output signal to a second clamping circuit 354, which prohibits the output current from exceeding a value of 4.5 mA.

Under the operating conditions where the total current demand has exceeded 4.5 mA, the electrostatic precipitator 10 is now in a condition where it is unsafe to continue operation. Because of this situation, clamping circuit 454 will not allow further current to be drawn, and the compliance voltage at outputs $V_{OUT1}$ and $V_{OUT2}$ will fall to a level at which the ionizer and collecting plates will not properly operate. In addition, another output from driver circuit #3 turns on the external lamp driver circuit 360. This external lamp driver circuit allows the red and yellow LEDs 352 and 332, respectively, to continue to be illuminated even though the main power supply voltages have fallen to an inoperable value. Finally, clamping circuit 354 limits the total output current at outputs $V_{OUT1}$ and $V_{OUT2}$ to 4.5 mA, which ultimately causes the compliance voltage at outputs $V_{OUT1}$ and $V_{OUT2}$ to fall to the level at which the ionizer and collecting plates cannot properly operate.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. In an improved electrostatic precipitator that contains a high-voltage power supply, at least one collecting cell having collecting plates at ground potential and collecting plates raised to a high voltage magnitude and an ionizer, an inlet and an outlet, and a source of electrical power, the improvement comprising: a high-voltage infeed assembly comprising an electrically insulative tubular body having a first end and a second end and at least one side wall therebetween, said body having a first through-hole and a second through-hole formed in said at least one side wall, said first and second through-holes being spaced apart from one another, said first through-hole having a first electrical conductor protruding therethrough, said second through-hole having a second electrical conductor protruding therethrough, said first electrical conductor being affixed and electrically-connected to a first flexible electrically conductive contact located at the exterior surface of said at least one side wall, said second electrical conductor being affixed and electrically-connected to a second flexible electrically conductive contact located at the exterior surface of said at least one side wall, two insulated electrically conductive wires extending within said body through said first end thereof, the first of said wires being electrically connected to said first electrical conductor within said body, and the second of said wires being electrically connected to said second electrical conductor within said body.

2. The electrostatic precipitator as recited in claim 1, further comprising a conduit fitting located at and affixed to the first end of said high-voltage infeed assembly.

3. The electrostatic precipitator as recited in claim 1, further comprising a mounting hole in the side wall of said high-voltage infeed assembly located at a position between said first and second through-holes.

4. The electrostatic precipitator as recited in claim 1, wherein said first and second flexible electrically conductive contacts of said high-voltage infeed assembly both physically abut electrically conductive protrusions located on the side of one of said at least one collecting cell.

5. The electrostatic precipitator as recited in claim 1, wherein said first and second flexible electrically conductive contacts of said high-voltage infeed assembly each comprise:

(a) a substantially flat, rigid plate, said rigid plate having a first end and a second end, said rigid plate having a mounting hole proximal its first end at which one of said protruding electrical conductors is attached, said rigid plate having an opening proximal to its second end; and (b) a flexible, electrically conductive contact plate, said flexible plate having a first end and a second end, said flexible plate having a mounting hole proximal to its first end at which one of said protruding electrical conductors is attached, said flexible plate's second end protruding through said opening of said rigid plate while and retained therein.

6. The electrostatic precipitator as recited in claim 5, wherein the second end of said flexible plate of said high-voltage infeed assembly is larger in width than the width of said opening of the rigid plate, and said flexible plate is shiftable between an extended, bulged free position and a depressed position when contacting an electrically conductive protrusion located on the side of one of said at least one collecting cell.

7. In an improved high-voltage power supply that contains an input rectifier stage, a switching regulation stage, and a step-up high voltage rectification output stage, the improvement comprising: an output current detector that creates a first signal related to the total output current being supplied by said power supply; a first comparator that determines whether or not said first signal is greater than a first predetermined magnitude and creates a second signal; a first timer that receives said second signal from the first comparator and, when said second signal is active, said first timer runs in an ON-delay mode until it times out, thereby creating a third signal which energizes a first warning lamp; a second comparator that determines whether or not said first signal is greater than a second predetermined magnitude and creates a fourth signal; a second timer that receives said fourth signal from the second comparator and, when said fourth signal is active, said second timer runs in an ON-delay mode until it times out, thereby creating a fifth signal which energizes a second warning lamp and energizes a clamping circuit that clamps the allowable total output current of said power supply to a maximum value substantially equal to a value corresponding to said second predetermined magnitude.

8. The improved high-voltage power supply as recited in claim 7, further comprising a flashing circuit that causes said first warning lamp to oscillate on and off during periods when it is energized by said third signal.

9. A method of supplying high-voltage power using a power supply that contains an input rectifier stage, a switching regulation stage, and a step-up high voltage rectification output stage, the improvement comprising the steps of: detecting the total output current being supplied by said power supply; determining whether or not said total output current is greater than a first predetermined magnitude; waiting for a first predetermined time interval and illuminating a first warning lamp if said total output current is continuously greater than said first predetermined magnitude for the entire first predetermined time interval; determining whether or not said total output current is greater than a second predetermined magnitude; waiting for a second predetermined time interval and illuminating a second warning lamp if said total output current is continuously greater than said second predetermined magnitude for the entire second predetermined time interval, and clamping the allowable total output current to a value substantially equal to said second predetermined magnitude.

10. The method as recited in claim 9, further comprising the step of flashing said first warning lamp while in its illuminated state.

* * * * *